US010007207B2

(12) United States Patent
Uno et al.

(10) Patent No.: US 10,007,207 B2
(45) Date of Patent: Jun. 26, 2018

(54) LIQUID DEVELOPER AND METHOD FOR MANUFACTURING THE SAME

(71) Applicant: Konica Minolta, Inc., Chiyoda-ku, Tokyo (JP)

(72) Inventors: Yukiko Uno, Kyoto (JP); Satoshi Matsumoto, Kyoto (JP); Naoki Yoshie, Ibaraki (JP); Miyuki Hotta, Kobe (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days. days.

(21) Appl. No.: 14/431,004

(22) PCT Filed: Sep. 11, 2013

(86) PCT No.: PCT/JP2013/074529
§ 371 (c)(1),
(2) Date: Mar. 25, 2015

(87) PCT Pub. No.: WO2014/050559
PCT Pub. Date: Apr. 3, 2014

(65) Prior Publication Data

US 2015/0277257 A1 Oct. 1, 2015

(30) Foreign Application Priority Data

Sep. 26, 2012 (JP) ..... 2012-212411

(51) Int. Cl.
*G03G 9/13* (2006.01)
*G03G 9/093* (2006.01)
(Continued)

(52) U.S. Cl.
CPC ..... *G03G 9/13* (2013.01); *G03G 9/0804* (2013.01); *G03G 9/093* (2013.01); *G03G 9/12* (2013.01)

(58) Field of Classification Search
CPC ..... G03G 9/0825; G03G 9/08704; G03G 9/08711; G03G 9/08728; G03G 9/08795;
(Continued)

(56) References Cited

U.S. PATENT DOCUMENTS 4,690,881 A * 9/1987 Nagai ..... G03G 9/131 430/114
5,468,585 A 11/1995 Matsumoto et al.
(Continued)

FOREIGN PATENT DOCUMENTS

JP 59-213428 A 12/1984
JP 1-285955 A 11/1989
(Continued)

OTHER PUBLICATIONS

OECID SIDS for methacrylic acid, published Dec. 2, 2001.*
(Continued)

*Primary Examiner* — Peter L Vajda
(74) *Attorney, Agent, or Firm* — Buchanan Ingersoll & Rooney PC

(57) ABSTRACT

A liquid developer in which toner particles are dispersed in an insulating liquid, the toner particles having such a core-shell structure that shell particles containing a shell resin are attached to or cover surfaces of core particles containing a core resin, the core resin having an acid group and an acid dissociation constant not smaller than 2.90 and not greater than 8.00, and a method for manufacturing the same are provided. The toner particles can have a volume average particle size not smaller than 0.01 μm and not greater than 100 μm and a coefficient of variation of volume distribution not lower than 1% and not higher than 100%. This liquid developer has excellent fixability which allows adaptation to
(Continued)

various recording materials, can be fixed in a wide temperature range, and is extremely low in deterioration in fixability during storage.

18 Claims, 1 Drawing Sheet

(51) Int. Cl.
*G03G 9/12* (2006.01)
*G03G 9/08* (2006.01)

(58) Field of Classification Search
CPC . G03G 9/093; G03G 9/09321; G03G 9/09364
See application file for complete search history.

(56) References Cited

U.S. PATENT DOCUMENTS

| | | | | |
|---|---|---|---|---|
| 5,789,133 | A * | 8/1998 | Yabuuchi | G03G 9/13 430/112 |
| 5,843,613 | A | 12/1998 | Fujiwara et al. | |
| 2008/0199221 | A1 | 8/2008 | Teshima et al. | |
| 2008/0199801 | A1* | 8/2008 | Akioka | G03G 9/12 430/112 |
| 2009/0253067 | A1* | 10/2009 | Yoshie | G03G 9/08797 430/114 |
| 2013/0034809 | A1* | 2/2013 | Iwata | G03G 9/13 430/114 |

FOREIGN PATENT DOCUMENTS

| | | | | |
|---|---|---|---|---|
| JP | H08-095297 | A | 4/1996 | |
| JP | 08-220813 | A | 8/1996 | |
| JP | 09-218540 | A | 8/1997 | |
| JP | 2002-244335 | A | 8/2002 | |
| JP | 2008-225442 | A | 9/2008 | |
| JP | 2009-96994 | A | 5/2009 | |
| JP | 2009-175670 | A | 8/2009 | |
| WO | WO 2011/129058 | * | 3/2011 | G03G 9/13 |
| WO | WO 2011/129058 | A1 | 10/2011 | |

OTHER PUBLICATIONS

International Search Report (PCT/ISA/210) dated Dec. 10, 2013, by the Japanese Patent Office as the International Searching Authority for International Application No. PCT/JP2013/074529.
Office Action (Notice of Grounds of Rejection) dated Jan. 24, 2017, by the Japanese Patent Office in corresponding Japanese Patent Application No. 2014-538364, and an English Translation of the Office Action. (14 pages).

* cited by examiner

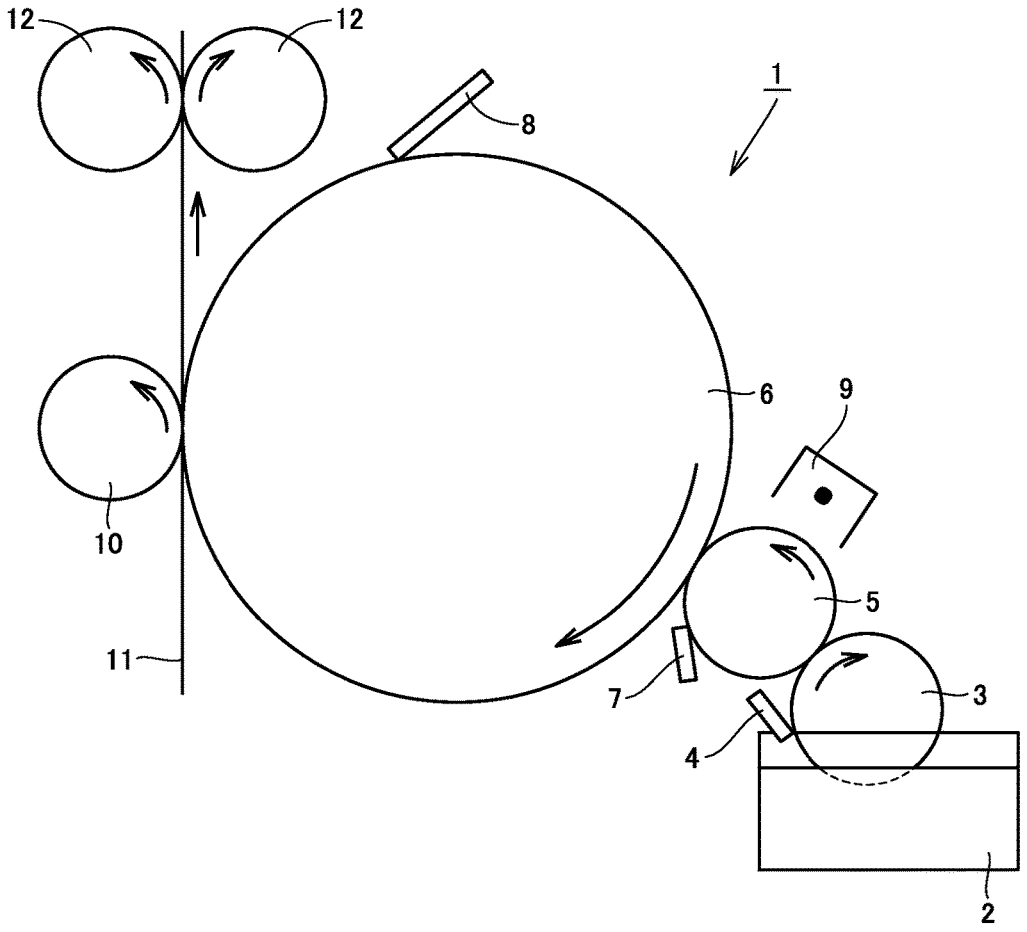
12
12
1
8
6
9
10
5
11
7
3
4
2

LIQUID DEVELOPER AND METHOD FOR MANUFACTURING THE SAME

TECHNICAL FIELD

The present invention relates to a liquid developer and a method for manufacturing the same. More specifically, the present invention relates to a liquid developer useful for various applications such as a liquid developer for electrophotography, a liquid developer for electrostatic recording, an oil-based ink for ink jet printer, or an ink for electronic paper and a method for manufacturing the same.

BACKGROUND ART

In using a liquid developer as a liquid developer for electrophotography, a liquid developer for electrostatic recording, an oil-based ink for ink jet printer, an ink for electronic paper, or the like, toner particles dispersed in the liquid developer are required to securely adhere to paper after fixation to paper and not to easily separate therefrom.

In order to enhance adhesiveness (hereinafter also denoted as fixability) to paper after fixation, various attempts have conventionally been made. For example, Japanese Laid-Open Patent Publication No. 2008-225442 (PTD 1) has proposed a method of adding fatty acid monoester to a nonaqueous dispersion medium and employing a polyester resin as a main component of resin particles.

CITATION LIST

Patent Document

PTD 1: Japanese Laid-Open Patent Publication No. 2008-225442

SUMMARY OF INVENTION

Technical Problem

From a point of view of higher speed and safety, a method of fixing toner particles with the use of a heat roller has been in a mainstream as a method of fixing toner particles to a recording material. From a point of view of energy saving, recently, such an attempt to simplify a temperature control mechanism of a heat roller or decrease in frequency of temperature control has also been made. Therefore, temperature variation in a heat roller tends to be larger than in a conventional example, and accordingly, a liquid developer has increasingly been desired to be fixable in a wide temperature range from a low temperature range to a high temperature range. In particular, prevention of occurrence of high-temperature offset (such a phenomenon that fixation quality lowers in a high temperature range) has been aimed.

Fixability improves to some extent owing to the technique according to PTD 1. In consideration of adaptation to various recording materials such as fine paper for which particularly high fixability is required, however, fixability is not yet sufficient. In addition, solving means sufficient from a point of view of prevention of high-temperature offset has not been provided either.

Furthermore, the technique according to PTD 1 has aimed to improve fixability of resin particles to paper by plasticization of a polyester resin by fatty acid monoester, however, it has been found that fixability degrades, for example, toner particles shed, when a recording material is stored in an environment at a high temperature and at a high humidity after fixation of toner particles.

The present invention was made in view of the circumstances as described above, and an object of the present invention is to provide a liquid developer which has excellent fixability allowing adaptation to various recording materials, can be fixed in a wide temperature range, and is extremely less in deterioration of fixability during storage, and a method for manufacturing the same.

Solution to Problem

In order to solve the problems above, the present inventors have conducted dedicated studies about a structure and a physical property of toner particles contained in a liquid developer, found that fixability drastically improves and storage characteristics after fixation are also maintained when toner particles have a core-shell structure constituted of two specific types of resins and the resins have an acid group and an acid dissociation constant within a certain range, and completed the present invention.

Namely, a liquid developer according to the present invention is a liquid developer (X) in which toner particles (C) are dispersed in an insulating liquid (L), characterized in that the toner particles (C) have a core-shell structure that shell particles (A) containing a shell resin (a) are attached to or cover surfaces of core particles (B) containing a core resin (b) and the core resin (b) has an acid group and an acid dissociation constant not smaller than 2.90 and not greater than 8.00.

Here, preferably, the toner particles (C) have a volume average particle size not smaller than 0.01 μm and not greater than 100 μm and the toner particles (C) have a coefficient of variation of volume distribution not lower than 1% and not higher than 100%.

Preferably, the toner particles (C) have an average value in circularity not smaller than 0.92 and not greater than 1.0.

Preferably, the shell resin (a) is at least one selected from the group consisting of a vinyl resin, a polyester resin, a polyurethane resin, and an epoxy resin.

Preferably, the shell resin (a) is a vinyl resin, and a homopolymer or a copolymer containing a constitutional unit derived from a monomer having polymerizable double bond.

Preferably, the monomer having polymerizable double bond is a vinyl monomer (m) having a molecular chain (k).

Preferably, the vinyl monomer (m) is at least one selected from the group consisting of a vinyl monomer (m1) having a straight-chain hydrocarbon chain having a carbon number from 12 to 27, a vinyl monomer (m2) having a branched hydrocarbon chain having a carbon number from 12 to 27, a vinyl monomer (m3) having a fluoro-alkyl chain having a carbon number from 4 to 20, and a vinyl monomer (m4) having a polydimethylsiloxane chain.

Preferably, the core resin (b) is at least one selected from the group consisting of a vinyl resin, a polyester resin, a polyurethane resin, and an epoxy resin.

Preferably, the core particles (B) contain at least one of a wax (c) and a modified wax (d) obtained by graft polymerization of a vinyl polymer chain with the wax.

Preferably, in the toner particles (C), a ratio of surface coverage of the core particles (B) with the shell particles (A) is not lower than 50%.

The liquid developer (X) is preferably a paint, a liquid developer for electrophotography, a liquid developer for electrostatic recording, an oil-based ink for ink jet printer, or an ink for electronic paper.

Preferably, the core particles (B) contain the core resin (b) and a coloring agent.

A method for manufacturing a liquid developer according to the present invention includes the steps of preparing a dispersion liquid (W) of shell particles (A), in which the shell particles (A) containing a shell resin (a) are dispersed in an insulating liquid (L), preparing a solution for forming core particles (B) obtained by dissolving a core resin (b) or a precursor (b0) of the core resin (b) in an organic solvent (M), forming core particles (B) containing the core resin (b) in the dispersion liquid (W) by dispersing the solution for forming core particles (B) in the dispersion liquid (W) of the shell particles (A) and obtaining toner particles (C) having a core-shell structure that the shell particles (A) are attached to or cover surfaces of the core particles (B), and obtaining a liquid developer (X) by distilling out the organic solvent (M) after the step of obtaining toner particles (C), characterized in that the core resin (b) has an acid group and an acid dissociation constant not smaller than 2.90 and not greater than 8.00.

Here, preferably, the organic solvent (M) has a solubility parameter from 8.5 to 20 $(cal/cm^3)^{1/2}$.

Advantageous Effects of Invention

With the features as above, the liquid developer according to the present invention has excellent effects of exhibiting excellent fixability which allows adaptation also to bond paper or the like, allowing fixation in a wide temperature range, and being extremely low in deterioration during storage after fixation.

BRIEF DESCRIPTION OF DRAWINGS

FIG. 1 is a schematic conceptual diagram of an image formation apparatus of an electrophotography type.

DESCRIPTION OF EMBODIMENTS

The present invention will be described hereinafter in further detail with reference to an embodiment. The liquid developer according to the present invention is not limited to a liquid developer shown below.

[Features of Liquid Developer]

A liquid developer (X) according to the present embodiment is useful as a liquid developer for electrophotography used in an image formation apparatus of an electrophotography type (which will be described later) such as a copying machine, a printer, a digital printer, or a simple printer, a paint, a liquid developer for electrostatic recording, an oil-based ink for ink jet printer, or an ink for electronic paper, and obtained by dispersing toner particles (C) in an insulating liquid (L). The toner particles (C) have such a core-shell structure that shell particles (A) containing a shell resin (a) are attached to or cover surfaces of core particles (B) containing a core resin (b).

<Shell Resin (a)>

The shell resin (a) in the present embodiment may be a thermoplastic resin or a thermosetting resin. The shell resin (a) is exemplified, for example, by a vinyl resin, a polyester resin, a polyurethane resin, an epoxy resin, a polyamide resin, a polyimide resin, a silicon resin, a phenol resin, a melamine resin, a urea resin, an aniline resin, an ionomer resin, and a polycarbonate resin. Two or more of the listed resins may be used together.

From a point of view of ease in obtaining the liquid developer (X) according to the present embodiment, as the shell resin (a), at least one selected from the group consisting of a vinyl resin, a polyester resin, a polyurethane resin, and an epoxy resin can be employed, and more preferably at least one of a polyester resin and a polyurethane resin can be employed.

<Vinyl Resin>

The vinyl resin may be a homopolymer containing a constitutional unit derived from a monomer having polymerizable double bond or a copolymer containing a constitutional unit derived from two or more types of monomers having polymerizable double bond. A monomer having polymerizable double bond is exemplified, for example, by (1) to (9) below.

(1) Hydrocarbon Having Polymerizable Double Bond

Hydrocarbon having polymerizable double bond is preferably, for example, aliphatic hydrocarbon having polymerizable double bond shown in (1-1) below, aromatic hydrocarbon having polymerizable double bond shown in (1-2) below, or the like.

(1-1) Aliphatic Hydrocarbon Having Polymerizable Double Bond

Aliphatic hydrocarbon having polymerizable double bond is preferably, for example, chain hydrocarbon having polymerizable double bond shown in (1-1-1) below, cyclic hydrocarbon having polymerizable double bond shown in (1-1-2) below, or the like.

(1-1-1) Chain Hydrocarbon Having Polymerizable Double Bond

Chain hydrocarbon having polymerizable double bond is exemplified, for example, by alkene having a carbon number from 2 to 30 (such as ethylene, propylene, butene, isobutylene, pentene, heptene, diisobutylene, octene, dodecene, or octadecene); alkadiene having a carbon number from 4 to 30 (such as butadiene, isoprene, 1,4-pentadiene, 1,5-hexadiene, or 1,7-octadiene); or the like.

(1-1-2) Cyclic Hydrocarbon Having Polymerizable Double Bond

Cyclic hydrocarbon having polymerizable double bond is exemplified, for example, by mono- or di-cycloalkene having a carbon number from 6 to 30 (such as cyclohexene, vinyl cyclohexane, or ethylidene bicycloheptene); mono- or di-cycloalkadiene having a carbon number from 5 to 30 (such as cyclopentadiene or dicyclopentadiene); or the like.

(1-2) Aromatic Hydrocarbon Having Polymerizable Double Bond

Aromatic hydrocarbon having polymerizable double bond is exemplified, for example, by styrene; hydrocarbon (such as alkyl, cycloalkyl, aralkyl, and/or alkenyl having a carbon number from 1 to 30) substitute of styrene (such as α-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinyl benzene, divinyl toluene, divinyl xylene, or trivinyl benzene); vinyl naphthalene; or the like.

(2) Monomer Having Carboxyl Group and Polymerizable Double Bond and Salt Thereof A monomer having a carboxyl group and polymerizable double bond is exemplified, for example, by unsaturated monocarboxylic acid having a carbon number from 3 to 15 [such as (meth)acrylic acid, crotonic acid, isocrotonic acid, or cinnamic acid]; unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid]; monoalkyl (having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester); or the like. "(Meth)acrylic (acid)" herein means acrylic (acid) and/or methacrylic (acid). Similarly, "(meth)acrylate" means "acrylate" and/or "methacrylate".

The salt of the monomer above is exemplified, for example, by alkali metal salt (such as sodium salt or potassium salt), alkaline earth metal salt (such as calcium salt or magnesium salt), ammonium salt, amine salt, and quaternary ammonium salt.

Amine salt is not particularly limited so long as it is an amine compound. Amine salt is exemplified, for example, by primary amine salt (such as ethylamine salt, butylamine salt, or octylamine salt); secondary amine salt (such as diethylamine salt or dibutylamine salt); tertiary amine salt (such as triethylamine salt or tributylamine salt); or the like.

Quaternary ammonium salt is exemplified, for example, by tetraethyl ammonium salt, triethyl lauryl ammonium salt, tetrabutyl ammonium salt, and tributyl lauryl ammonium salt.

Salt of the monomer having a carboxyl group and polymerizable double bond is exemplified, for example, by sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, and aluminum acrylate.

(3) Monomer Having Sulfo Group and Polymerizable Double Bond and Salt Thereof

A monomer having a sulfo group and polymerizable double bond is exemplified, for example, by alkene sulfonic acid having a carbon number from 2 to 14 [such as vinyl sulfonic acid, (meth)allyl sulfonic acid, or methyl vinyl sulfonic acid]; styrene sulfonic acid, an alkyl (having a carbon number from 2 to 24) derivative of styrene sulfonic acid (such as α-methylstyrene sulfonic acid), sulfo(hydroxy) alkyl-(meth)acrylate having a carbon number from 5 to 18 [such as sulfopropyl (meth)acrylate, 2-hydroxy-3-(meth) acryloxy propylsulfonic acid, 2-(meth)acryloyloxyethane sulfonic acid, or 3-(meth)acryloyloxy-2-hydroxypropane sulfonic acid]; sulfo(hydroxy)alkyl(meth)acrylamide having a carbon number from 5 to 18 [such as 2-(meth)acryloylamino-2,2-dimethylethane sulfonic acid, 2-(meth)acrylamide-2-methylpropane sulfonic acid, or 3-(meth)acrylamide-2-hydroxypropane sulfonic acid]; alkyl (having a carbon number from 3 to 18) allylsulfo succinic acid (such as propylallylsulfo succinic acid, butylallylsulfo succinic acid, or 2-ethylhexyl-allylsulfo succinic acid); poly-[n ("n" representing a degree of polymerization; to be understood similarly hereinafter)=2 to 30] oxyalkylene (such as oxyethylene, oxypropylene, or oxybutylene; polyoxyalkylene may be a homopolymer of oxyalkylene or a copolymer of oxyalkylene; if polyoxyalkylene is a copolymer of oxyalkylene, it may be a random polymer or a block polymer); sulfate ester of mono(meth)acrylate [such as sulfate ester of poly-(n=5 to 15) oxyethylene monomethacrylate or sulfate ester of poly-(n=5 to 15) oxypropylene monomethacrylate]; a compound expressed with Chemical Formulae (1) to (3) below; or the like.

Chemical Formula (1)

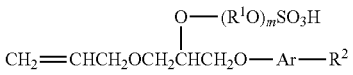

-continued

Chemical Formula (2)

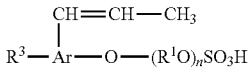

Chemical Formula (3)

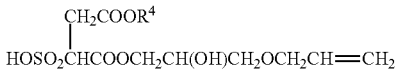

In Chemical Formulae (1) to (3) above, $R^1$ represents an alkylene group having a carbon number from 2 to 4. When Chemical Formula (1) includes two or more $R^1$Os, two or more $R^1$Os may be composed of the same alkylene group or of two or more types of alkylene groups as combined. When two or more types of alkylene groups are used as combined, a sequence of $R^1$ in Chemical Formula (1) may be a random sequence or a block sequence. $R^2$ and $R^3$ each independently represent an alkyl group having a carbon number from 1 to 15. m and n are each independently an integer from 1 to 50. Ar represents a benzene ring. $R^4$ represents an alkyl group having a carbon number from 1 to 15, which may be substituted with a fluorine atom.

Salt of a monomer having a sulfo group and polymerizable double bond is exemplified, for example, by alkali metal salt, alkaline earth metal salt, ammonium salt, amine salt, and quaternary ammonium salt similarly to those listed as the "salt of the monomer above" in "(2) Monomer Having Carboxyl Group and Polymerizable Double Bond" above.

(4) Monomer Having Phosphono Group and Polymerizable Double Bond and Salt Thereof A monomer having a phosphono group and polymerizable double bond is exemplified, for example, by (meth)acryloyloxy alkyl phosphate monoester (a carbon number of an alkyl group being from 1 to 24) [such as 2-hydroxyethyl (meth)acryloyl phosphate or phenyl-2-acryloyloxy ethyl phosphate]; (meth)acryloyloxy alkyl phosphonic acid (a carbon number of an alkyl group being from 1 to 24) (such as 2-acryloyloxy ethyl phosphonic acid); or the like.

Salt of the monomer having a phosphono group and polymerizable double bond is exemplified, for example, by alkali metal salt, alkaline earth metal salt, ammonium salt, amine salt, and quaternary ammonium salt similarly to those listed as the "salt of the monomer above" in "(2) Monomer Having Carboxyl Group and Polymerizable Double Bond" above.

(5) Monomer Having Hydroxyl Group and Polymerizable Double Bond

A monomer having a hydroxyl group and polymerizable double bond is exemplified, for example, by hydroxystyrene, N-methylol(meth)acrylamide, hydroxyethyl(meth) acrylate, hydroxypropyl(meth)acrylate, polyethylene glycol mono(meth)acrylate, (meth)allyl alcohol, crotyl alcohol, isocrotyl alcohol, 1-butene-3-ol, 2-butene-1-ol, 2-butene-1, 4-diol, propargyl alcohol, 2-hydroxyethyl propenyl ether, sucrose allyl ether, and the like.

(6) Nitrogen-Containing Monomer Having Polymerizable Double Bond

A nitrogen-containing monomer having polymerizable double bond is exemplified, for example, by a monomer shown in (6-1) to (6-4) below.

(6-1) Monomer Having Amino Group and Polymerizable Double Bond

A monomer having an amino group and polymerizable double bond is exemplified, for example, by aminoethyl (meth)acrylate, dimethylaminoethyl(meth)acrylate, diethylaminoethyl(meth)acrylate, t-butylaminoethyl methacrylate, N-aminoethyl(meth)acrylamide, (meth)allyl amine, morpholinoethyl(meth)acrylate, 4-vinylpyridine, 2-vinylpyridine, crotyl amine, N,N-dimethylamino styrene, methyl-α-acetamino acrylate, vinylimidazole, N-vinylpyrrole, N-vinyl thiopyrrolidone, N-aryl phenylenediamine, aminocarbazole, aminothiazole, aminoindole, aminopyrrole, aminoimidazole, aminomercaptothiazole, and the like.

The monomer having an amino group and polymerizable double bond may be the salts of the monomer listed above. The salts of the monomer listed above are exemplified, for example, by alkali metal salt, alkaline earth metal salt, ammonium salt, amine salt, and quaternary ammonium salt similarly to those listed as the "salt of the monomer above" in "(2) Monomer Having Carboxyl Group and Polymerizable Double Bond" above.

(6-2) Monomer Having Amide Group and Polymerizable Double Bond

A monomer having an amide group and polymerizable double bond is exemplified, for example, by (meth)acrylamide, N-methyl(meth)acrylamide, N-butyl acrylamide, diacetone acrylamide, N-methylol(meth)acrylamide, N,N'-methylene-bis(meth)acrylamide, cinnamic acid amide, N,N-dimethylacrylamide, N,N-dibenzylacrylamide, methacrylformamide, N-methyl-N-vinylacetamide, N-vinylpyrrolidone, and the like.

(6-3) Monomer Having Carbon Number from 3 to 10 and Having Nitrile Group and Polymerizable Double Bond A monomer having a carbon number from 3 to 10 and having a nitrile group and polymerizable double bond is exemplified, for example, by (meth)acrylonitrile, cyanostyrene, cyanoacrylate, and the like.

(6-4) Monomer Having Carbon Number from 8 to 12 and Having Nitro Group and Polymerizable Double Bond A monomer having a carbon number from 8 to 12 and having a nitro group and polymerizable double bond is exemplified, for example, by nitrostyrene or the like.

(7) Monomer Having Carbon Number from 6 to 18 and Having Epoxy Group and Polymerizable Double Bond A monomer having a carbon number from 6 to 18 and having an epoxy group and polymerizable double bond is exemplified, for example, by glycidyl(meth)acrylate or the like.

(8) Monomer Having Carbon Number from 2 to 16 and Having Halogen Element and Polymerizable Double Bond A monomer having a carbon number from 2 to 16 and having a halogen element and polymerizable double bond is exemplified, for example, by vinyl chloride, vinyl bromide, vinylidene chloride, allyl chloride, chlorostyrene, bromostyrene, dichlorostyrene, chloromethylstyrene, tetrafluorostyrene, chloroprene, and the like.

(9) Others

Other than the monomers above, a monomer having polymerizable double bond is exemplified by a monomer shown in (9-1) to (9-4) below.

(9-1) Ester Having Carbon Number from 4 to 16 and Having Polymerizable Double Bond An ester having a carbon number from 4 to 16 and having polymerizable double bond is exemplified, for example, by vinyl acetate; vinyl propionate; vinyl butyrate; diallyl phthalate; diallyl adipate; isopropenyl acetate; vinyl methacrylate; methyl-4-vinyl benzoate; cyclohexyl methacrylate; benzyl methacrylate; phenyl(meth)acrylate; vinyl methoxy acetate; vinyl benzoate; ethyl-α-ethoxy acrylate; alkyl(meth)acrylate having an alkyl group having a carbon number from 1 to 11 [such as methyl(meth)acrylate, ethyl(meth)acrylate, propyl (meth)acrylate, butyl(meth)acrylate, or 2-ethylhexyl(meth) acrylate]; dialkyl fumarate (two alkyl groups being straight-chain alkyl groups, branched alkyl groups, or alicyclic alkyl groups, having a carbon number from 2 to 8); dialkyl maleate (two alkyl groups being straight-chain alkyl groups, branched alkyl groups, or alicyclic alkyl groups, having a carbon number from 2 to 8); poly(meth)allyloxy alkanes (such as diallyloxyethane, triallyloxyethane, tetraallyloxyethane, tetraallyloxypropane, tetraallyloxybutane, or tetramethallyloxyethane); a monomer having a polyalkylene glycol chain and polymerizable double bond {such as polyethylene glycol [a number average molecular weight (hereinafter also denoted as "Mn")=300] mono(meth)acrylate, polypropylene glycol (Mn=500) monoacrylate, a 10-mole adduct (meth)acrylate of ethylene oxide (hereinafter "ethylene oxide" also being denoted as "EO") to methyl alcohol or a 30-mole adduct (meth)acrylate of EO to lauryl alcohol}; poly(meth)acrylates {such as poly(meth)acrylate of polyhydric alcohols [such as ethylene glycol di(meth) acrylate, propylene glycol di(meth)acrylate, neopentyl glycol di(meth)acrylate, trimethylol propane tri(meth)acrylate, or polyethylene glycol di(meth)acrylate]}, or the like.

(9-2) Ether Having Carbon Number from 3 to 16 and Having Polymerizable Double Bond Ether having a carbon number from 3 to 16 and having polymerizable double bond is exemplified, for example, by vinyl methyl ether, vinyl ethyl ether, vinyl propyl ether, vinyl butyl ether, vinyl-2-ethyl hexyl ether, vinyl phenyl ether, vinyl-2-methoxy ethyl ether, methoxy butadiene, vinyl-2-butoxyethyl ether, 3,4-dihydro-1,2-pyran, 2-butoxy-2'-vinyloxy diethyl ether, acetoxystyrene, phenoxystyrene, and the like.

(9-3) Ketone Having Carbon Number from 4 to 12 and Having Polymerizable Double Bond Ketone having a carbon number from 4 to 12 and having polymerizable double bond is exemplified, for example, by vinyl methyl ketone, vinyl ethyl ketone, vinyl phenyl ketone, and the like.

(9-4) Sulfur Containing Compound Having Carbon Number from 2 to 16 and Having Polymerizable Double Bond A sulfur containing compound having a carbon number from 2 to 16 and having polymerizable double bond is exemplified, for example, by divinyl sulfide, p-vinyl diphenyl sulfide, vinyl ethyl sulfide, vinyl ethyl sulfone, divinyl sulfone, divinylsulfoxide, and the like.

A specific example of a copolymer among vinyl resins above is exemplified, for example, by a styrene-(meth) acrylic acid ester copolymer, a styrene-butadiene copolymer, a (meth)acrylic acid-(meth)acrylic acid ester copolymer, a styrene-acrylonitrile copolymer, a styrene-maleic acid (maleic anhydride) copolymer, a styrene-(meth)acrylic acid copolymer, a styrene-(meth)acrylic acid-divinylbenzene copolymer, a styrene-styrene sulfonic acid-(meth)acrylic acid ester copolymer, and the like.

The shell resin (a) may be a homopolymer or a copolymer of a monomer having polymerizable double bond in (1) to (9) above, that is, a homopolymer or a copolymer containing a constitutional unit derived from a vinyl monomer, or it may be a polymerized product of a monomer having polymerizable double bond in (1) to (9) above and a vinyl monomer (m) having a molecular chain (k) and having polymerizable double bond. The molecular chain (k) is exemplified by a straight-chain or branched hydrocarbon chain having a carbon number from 12 to 27, a fluoro-alkyl chain having a carbon number from 4 to 20, a polydimethylsiloxane chain, and the like. A difference in SP value between the molecular chain (k) in the vinyl monomer (m) and the insulating liquid (L) is preferably 2 or smaller. The "SP value" herein is a numeric value calculated with a Fedors' method [Polym. Eng. Sci. 14(2) 152, (1974)].

Though the vinyl monomer (m) having the molecular chain (k) and polymerizable double bond is not particularly limited, it is exemplified, for example, by vinyl monomers (m1) to (m4) below. Two or more of the vinyl monomers (m1) to (m4) may be used together as the vinyl monomer (m).

Vinyl Monomer (m1) having Straight-Chain Hydrocarbon Chain having Carbon Number from 12 to 27 (Preferably from 16 to 25)

Such a vinyl monomer (m1) is exemplified, for example, by mono-straight-chain alkyl (a carbon number of alkyl being from 12 to 27) ester of unsaturated monocarboxylic acid, mono-straight-chain alkyl (a carbon number of alkyl being from 12 to 27) ester of unsaturated dicarboxylic acid, and the like. The unsaturated monocarboxylic acid and unsaturated dicarboxylic acid are exemplified, for example, by a carboxyl group containing vinyl monomer having a carbon number from 3 to 24 such as (meth)acrylic acid, maleic acid, fumaric acid, crotonic acid, itaconic acid, and citraconic acid.

A specific example of the vinyl monomer (m1) is, exemplified, for example, by dodecyl(meth)acrylate, stearyl (meth)acrylate, behenyl(meth)acrylate, hexadecyl(meth) acrylate, heptadecyl(meth)acrylate, eicosyl(meth)acrylate, and the like.

Vinyl Monomer (m2) having Branched Hydrocarbon Chain having Carbon Number from 12 to 27 (Preferably from 16 to 25) and Polymerizable Double Bond Such a vinyl monomer (m2) is exemplified, for example, by mono-branched alkyl (a carbon number of alkyl being from 12 to 27) ester of unsaturated monocarboxylic acid, mono-branched alkyl (a carbon number of alkyl being from 12 to 27) ester of unsaturated dicarboxylic acid, and the like. Unsaturated monocarboxylic acid and unsaturated dicarboxylic acid are exemplified, for example, by those the same as listed as specific examples of unsaturated monocarboxylic acid and unsaturated dicarboxylic acid with regard to the vinyl monomer (m1).

A specific example of the vinyl monomer (m2) is exemplified, for example, by 2-decyltetradecyl(meth)acrylate or the like.

Vinyl Monomer (m3) having Fluoro-Alkyl Chain having Carbon Number from 4 to 20 and Polymerizable Double Bond Such a vinyl monomer (m3) is exemplified, for example, by perfluoroalkyl (alkyl) (meth)acrylic acid ester or the like expressed with a Chemical Formula (4) below.

$$CH_2{=}CR{-}COO{-}(CH_2)_p{-}(CF_3)_q{-}Z \qquad \text{Chemical Formula (4)}$$

In Chemical Formula (4) above, R represents a hydrogen atom or a methyl group, p represents an integer from 0 to 3, q represents any of 2, 4, 6, 8, 10, and 12, and Z represents a hydrogen atom or a fluorine atom.

A specific example of the vinyl monomer (m3) is exemplified, for example, by [(2-perfluoroethyl)ethyl](meth) acrylic acid ester, [(2-perfluorobutyl)ethyl](meth)acrylic acid ester, [(2-perfluorohexyl)ethyl](meth)acrylic acid ester, [(2-perfluorooctyl)ethyl](meth)acrylic acid ester, [(2-perfluorodecyl)ethyl](meth)acrylic acid ester, [(2-perfluorododecyl)ethyl](meth)acrylic acid ester, and the like.

Vinyl Monomer (m4) having Polydimethylsiloxane Chain and Polymerizable Double Bond Such a vinyl monomer (m4) is exemplified, for example, by (meth)acrylic modified silicone or the like expressed with a Chemical Formula (5) below.

$$CH_2{=}CR{-}COO{-}((CH_3)_2SiO)_m{-}Si(CH_3)_3 \qquad \text{Chemical Formula (5)}$$

In Chemical Formula (5) above, R represents a hydrogen atom or a methyl group and m is from 15 to 45 on average.

A specific example of the vinyl monomer (m4) is exemplified, for example, by modified silicone oil (such a trade name as "X-22-174DX", "X-22-2426", or "X-22-2475" manufactured by Shin-Etsu Chemical Co., Ltd.).

Among the vinyl monomers (m1) to (m4), a preferred monomer is the vinyl monomer (m1) or the vinyl monomer (m2) and a more preferred monomer is the vinyl monomer (m2).

A content of the vinyl monomer (m) is preferably not lower than 10 mass % and not higher than 90 mass %, more preferably not lower than 15 mass % and not higher than 80 mass %, and further preferably not lower than 20 mass % and not higher than 60 mass %, with respect to a mass of the vinyl resin. So long as the content of the vinyl monomer (m) is within the range above, toner particles (C) are less likely to unite with each other.

In a case where a monomer having polymerizable double bond in (1) to (9) above, the vinyl monomer (m1), and the vinyl monomer (m2) are polymerized to make up a vinyl resin, from a point of view of particle size distribution of the toner particles (C) and fixability of the toner particles (C), a mass ratio between the vinyl monomer (m1) and the vinyl monomer (m2) [(m1):(m2)] is preferably from 90:10 to 10:90, more preferably from 80:20 to 20:80, and further preferably from 70:30 to 30:70.

<Polyester Resin>

A polyester resin is exemplified, for example, by a polycondensed product or the like of polyol and polycarboxylic acid, acid anhydride of polycarboxylic acid, or lower alkyl (a carbon number of an alkyl group being from 1 to 4) ester of polycarboxylic acid. A known polycondensation catalyst or the like can be used for polycondensation reaction.

Polyol is exemplified, for example, by diol (10), polyol (11) having valence from 3 to 8 or higher (hereinafter abbreviated as "polyol (11)"), and the like.

Polycarboxylic acid is exemplified, for example, by dicarboxylic acid (12), polycarboxylic acid (13) having valence from 3 to 6 or higher (hereinafter abbreviated as "polycarboxylic acid (13)"), and the like. Acid anhydride of polycarboxylic acid is exemplified, for example, by acid anhydride of dicarboxylic acid (12), acid anhydride of polycarboxylic acid (13), and the like. Lower alkyl ester of polycarboxylic acid is exemplified, for example, by lower alkyl ester of dicarboxylic acid (12), lower alkyl ester of polycarboxylic acid (13), and the like.

A ratio between polyol and polycarboxylic acid is not particularly limited. A ratio between polyol and polycarboxylic acid should only be set such that an equivalent ratio between a hydroxyl group [OH] and a carboxyl group [COOH]([OH]/[COOH]) is set preferably to 2/1 to 1/5, more preferably to 1.5/1 to 1/4, and further preferably to 1.3/1 to 1/3.

Diol (10) is exemplified, for example, by alkylene glycol having a carbon number from 2 to 30 (such as ethylene glycol, 1,2-propylene glycol, 1,3-propylene glycol, 1,4-butanediol, 1,6-hexanediol, octanediol, decanediol, dodecanediol, tetradecanediol, neopentylglycol, or 2,2-diethyl-1,3-propanediol); alkylene ether glycol having Mn not smaller than 106 and not greater than 10000 (such as diethylene glycol, triethylene glycol, dipropylene glycol, polyethylene glycol, polypropylene glycol, or polytetramethylene ether glycol); alicyclic diol having a carbon number from 6 to 24 (such as 1,4-cyclohexanedimethanol or hydrogenated bisphenol A); an adduct (the number of added moles being from 2 to 100) of alkylene oxide (hereinafter "alkylene oxide"

also being denoted as "AO") to alicyclic diol above having Mn not smaller than 100 and not greater than 10000 (such as a 10-mole adduct of EO to 1,4-cyclohexanedimethanol); an adduct (the number of added moles being from 2 to 100) of AO [such as EO, propylene oxide (hereinafter also being denoted as "PO"), or butylene oxide] to bisphenols having a carbon number from 15 to 30 (such as bisphenol A, bisphenol F, or bisphenol S) or an adduct of AO to polyphenol having a carbon number from 12 to 24 (such as catechol, hydroquinone, or resorcin) (such as a 2 to 4-mole adduct of EO to bisphenol A or a 2 to 4-mole adduct of PO to bisphenol A); polylactonediol having a weight average molecular weight (hereinafter also being denoted as "Mw") not smaller than 100 and not greater than 5000 (such as poly-ε-caprolactonediol); polybutadienediol having Mw not smaller than 1000 and not greater than 20000; or the like.

Among these, as diol (10), alkylene glycol and an adduct of AO to bisphenols are preferred and an adduct alone of AO to bisphenols and a mixture of an adduct of AO to bisphenols and alkylene glycol are more preferred.

Polyol (11) is exemplified, for example, by aliphatic polyhydric alcohol having valence from 3 to 8 or higher and having a carbon number from 3 to 10 (such as glycerol, trimethylolethane, trimethylolpropane, pentaerythritol, sorbitan, or sorbitol); an adduct (the number of added moles being from 2 to 100) of AO (having a carbon number from 2 to 4) to trisphenol having a carbon number from 25 to 50 (such as a 2 to 4-mole adduct of EO to trisphenol or a 2 to 4-mole adduct of PO to trisphenol polyamide); an adduct (the number of added moles being from 2 to 100) of AO (having a carbon number from 2 to 4) to a novolac resin (such as phenol novolac or cresol novolac) having n=3 to 50 (such as a 2-mole adduct of PO to phenol novolac or a 4-mole adduct of EU to phenol novolac); an adduct (the number of added moles being from 2 to 100) of AO (having a carbon number from 2 to 4) to polyphenol having a carbon number from 6 to 30 (such as pyrogallol, phloroglucinol, or 1,2,4-benzenetriol) (such as a 4-mole adduct of EO to pyrogallol); acrylic polyol having n=20 to 2000 {such as a copolymer of hydroxyethyl(meth)acrylate and other monomer having polymerizable double bond [such as styrene, (meth)acrylic acid, or (meth)acrylic acid ester]}; or the like.

Among these, as polyol (11), aliphatic polyhydric alcohol and an adduct of AO to a novolac resin are preferred, and an adduct of AO to a novolac resin is more preferred.

Dicarboxylic acid (12) is exemplified, for example, by alkane dicarboxylic acid having a carbon number from 4 to 32 (such as succinic acid, adipic acid, sebacic acid, azelaic acid, dodecane dicarboxylic acid, or octadecane dicarboxylic acid); alkene dicarboxylic acid having a carbon number from 4 to 32 (such as maleic acid, fumaric acid, citraconic acid, or mesaconic acid); branched alkene dicarboxylic acid having a carbon number from 8 to 40 [such as dimer acid or alkenyl succinic acid (such as dodecenyl succinic acid, pentadecenyl succinic acid, or octadecenyl succinic acid)]; branched alkane dicarboxylic acid having a carbon number from 12 to 40 [such as alkyl succinic acid (such as decyl succinic acid, dodecyl succinic acid, or octadecyl succinic acid)]; aromatic dicarboxylic acid having a carbon number from 8 to 20 (such as phthalic acid, isophthalic acid, terephthalic acid, or naphthalene dicarboxylic acid); or the like.

Among these, as dicarboxylic acid (12), alkene dicarboxylic acid and aromatic dicarboxylic acid are preferred, and aromatic dicarboxylic acid is more preferred.

Polycarboxylic acid (13) is exemplified, for example, by aromatic polycarboxylic acid having a carbon number from 9 to 20 (such as trimellitic acid or pyromellitic acid) or the like.

The acid anhydride of dicarboxylic acid (12) and polycarboxylic acid (13) is exemplified, for example, by trimellitic anhydride, pyromellitic anhydride, and the like. The lower alkyl ester of dicarboxylic acid (12) and polycarboxylic acid (13) is exemplified, for example, by methyl ester, ethyl ester, isopropyl ester, and the like.

<Polyurethane Resin>

A polyurethane resin is exemplified, for example, by a polyadduct of polyisocyanate (14) and an active hydrogen containing compound {for example, water; polyol [such as diol (10) (including diol having a functional group other than a hydroxyl group) or polyol (11)]; polycarboxylic acid [such as dicarboxylic acid (12) or polycarboxylic acid (13)]; polyester polyol obtained by polycondensation between polyol and polycarboxylic acid; a ring-opening polymer of lactone having a carbon number from 6 to 12; polyamine (15); and polythiol (16); or use thereof as being combined}, or may be an amino group containing polyurethane resin obtained by causing a terminal isocyanate group prepolymer resulting from reaction between polyisocyanate (14) and the active hydrogen containing compound to react with primary and/or secondary monoamine(s) (17) in parts equal to an isocyanate group of the terminal isocyanate group prepolymer.

A content of a carboxyl group in the polyurethane resin is preferably not lower than 0.1 mass % and not higher than 10 mass %.

Polyisocyanate (14) is exemplified, for example, by aromatic polyisocyanate having a carbon number from 6 to 20 (except for carbon in an NCO group; hereinafter to be similarly understood in <Polyurethane Resin>); aliphatic polyisocyanate having a carbon number from 2 to 18; a modified product of these polyisocyanates (such as a modified product including a urethane group, a carbodiimide group, an allophanate group, a urea group, a biuret group, a uretdione group, a uretonimine group, an isocyanurate group, an oxazolidone group, or the like); or two or more of these as being used together.

Aromatic polyisocyanate is exemplified, for example, by 1,3- or 1,4-phenylene diisocyanate; 2,4- or 2,6-tolylene diisocyanate (hereinafter also being denoted as "TDI"); crude TDI; m- or p-xylylene diisocyanate; α,α,α',α'-tetramethylxylylene diisocyanate; 2,4'- or 4,4'-diphenylmethane diisocyanate (hereinafter also being denoted as "MDI"); crude MDI (such as a phosgenated product of crude diaminophenylmethane [such as a condensed product of formaldehyde and aromatic amine (one type may be used or two or more types may be used together) or a mixture of diaminodiphenylmethane and a small amount (for example, not lower than 5 mass % and not higher than 20 mass %) of polyamine having three or more amine groups] or polyallyl polyisocyanate}; 1,5-naphtylene diisocyanate; 4,4',4"-triphenylmethane triisocyanate; m- or p-isocyanatophenylsulfonyl isocyanate; or two or more of these as being used together.

Aliphatic polyisocyanate is exemplified, for example, by chain aliphatic polyisocyanate, cyclic aliphatic polyisocyanate, and the like.

Chain aliphatic polyisocyanate is exemplified, for example, by ethylene diisocyanate; tetramethylene diisocyanate; hexamethylene diisocyanate (hereinafter also being denoted as "HDI"); dodecamethylene diisocyanate; 1,6,11-undecane triisocyanate; 2,2,4-trimethyl hexamethylene diisocyanate; lysine diisocyanate; 2,6-diisocyanatomethyl caproate; bis(2-isocyanatoethyl) fumarate; bis(2-isocyanatoethyl) carbonate; 2-isocyanatoethyl-2,6-diisocyanatohexanoate; or two or more of these as being used together.

Cyclic aliphatic polyisocyanate is exemplified, for example, by isophoron diisocyanate (hereinafter also being denoted as "IPDI"); dicyclohexylmethane-4,4'-diisocyanate (hydrogenated MDI); cyclohexylene diisocyanate; methylcyclohexylene diisocyanate (hydrogenated TDI); bis(2-isocyanatoethyl)-4-cyclohexene-1,2-dicarboxylate; 2,5- or 2,6-norbornane diisocyanate; or two or more of these as being used together.

A modified product of polyisocyanate is exemplified by a polyisocyanate compound containing at least one of a urethane group, a carbodiimide group, an allophanate group, a urea group, a biuret group, a uretdione group, a uretonimine group, an isocyanurate group, and an oxazolidone group, or the like. The modified product of polyisocyanate is exemplified, for example, by modified MDI (such as urethane-modified MDI, carbodiimide-modified MDI, or trihydrocarbyl-phosphate-modified MDI); urethane-modified TDI; use of two or more types of these [such as use of modified MDI and urethane-modified TDI (such as an isocyanate containing prepolymer) as combined]; or the like.

Among these, as polyisocyanate (14), aromatic polyisocyanate having a carbon number from 6 to 15 and aliphatic polyisocyanate having a carbon number from 4 to 15 are preferred. TDI, MDI, HDI, hydrogenated MDI, and IPDI are more preferred.

Polyamine (15) is exemplified, for example, by aliphatic polyamine having a carbon number from 2 to 18, aromatic polyamine (having a carbon number, for example, from 6 to 20), and the like.

Aliphatic polyamine having a carbon number from 2 to 18 is exemplified, for example, by chain aliphatic polyamine; an alkyl (having a carbon number from 1 to 4) substitute of chain aliphatic polyamine; a hydroxyalkyl (having a carbon number from 2 to 4) substitute of chain aliphatic polyamine; cyclic aliphatic polyamine; or the like.

Chain aliphatic polyamine is exemplified, for example, by alkylene diamine having a carbon number from 2 to 12 (such as ethylene diamine, propylene diamine, trimethylene diamine, tetramethylene diamine, or hexamethylene diamine); polyalkylene (having a carbon number from 2 to 6) polyamine [such as diethylene triamine, iminobispropylamine, bis(hexamethylene) triamine, triethylenetetramine, tetraethylenepentamine, or pentaethylenehexamine]; or the like.

The alkyl (having a carbon number from 1 to 4) substitute of chain aliphatic polyamine and the hydroxyalkyl (having a carbon number from 2 to 4) substitute of chain aliphatic polyamine are exemplified, for example, by dialkyl (having a carbon number from 1 to 3) aminopropyl amine; trimethyl hexamethylene diamine; aminoethyl ethanol amine; 2,5-dimethyl-2,5-hexamethylene diamine; methyliminobispropylamine; or the like.

Cyclic aliphatic polyamine is exemplified, for example, by alicyclic polyamine having a carbon number from 4 to 15 [such as 1,3-diaminocyclohexane, isophoron diamine, menthene diamine, 4,4'-methylene dicyclohexane diamine (hydrogenated methylenedianiline), or 3,9-bis(3-aminopropyl)-2,4,8,10-tetraoxaspiro[5,5]undecane]; heterocyclic polyamine having a carbon number from 4 to 15 [such as piperazine, N-aminoethylpiperazine, 1,4-diaminoethylpiperazine, or 1,4-bis(2-amino-2-methylpropyl)piperazine]; or the like.

Aromatic polyamine (having a carbon number from 6 to 20) is exemplified, for example, by non-substituted aromatic polyamine; aromatic polyamine having an alkyl group (for example, an alkyl group having a carbon number from 1 to 4, such as a methyl group, an ethyl group, an n- or iso-propyl group, and a butyl group); aromatic polyamine having an electron-withdrawing group (such as halogen atoms such as Cl, Br, I, and F; an alkoxy group such as a methoxy group and an ethoxy group, and a nitro group); aromatic polyamine having a secondary amino group; or the like.

Non-substituted aromatic polyamine is exemplified, for example, by 1,2-, 1,3-, or 1,4-phenylene diamine; 2,4'- or 4,4'-diphenyl methane diamine; crude diphenyl methane diamine (such as polyphenyl polymethylene polyamine); diaminodiphenyl sulfone; benzidine; thiodianiline; bis(3,4-diaminophenyl) sulfone; 2,6-diaminopyridine; m-aminobenzyl amine; triphenylmethane-4,4',4"-triamine; naphtylene diamine; or two or more of these as being used together.

Aromatic polyamine having an alkyl group (for example, an alkyl group having a carbon number from 1 to 4, such as a methyl group, an ethyl group, an n- or iso-propyl group, and a butyl group) is exemplified, for example, by 2,4- or 2,6-tolylene diamine, crude tolylene diamine, diethyl tolylene diamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-diethyl-2,4-diaminobenzene, 1,3-dimethyl-2,6-diaminobenzene, 1,4-diethyl-2,5-diamino benzene, 1,4-diisopropyl-2,5-diaminobenzene, 1,4-dibutyl-2,5-diaminobenzene, 2,4-diaminomesitylene, 1,3,5-triethyl-2,4-diaminobenzene, 1,3,5-triisopropyl-2,4-diaminobenzene, 1-methyl-3,5-diethyl-2,4-diaminobenzene, 1-methyl-3,5-diethyl-2,6-diaminobenzene, 2,3-dimethyl-1,4-diaminonaphthalene, 2,6-dimethyl-1,5-diaminonaphthalene, 2,6-diisopropyl-1,5-diaminonaphthalene, 2,6-dibutyl-1,5-diaminonaphthalene, 3,3',5,5'-tetramethylbenzidine, 3,3',5,5'-tetraisopropylbenzidine, 3,3',5,5'-tetramethyl-4,4'-diaminodiphenylmethane, 3,3',5,5'-tetraethyl-4,4'-diaminodiphenylmethane, 3,3',5,5'-tetraisopropyl-4,4'-diaminodiphenylmethane, 3,3',5,5'-tetrabutyl-4,4'-diaminodiphenylmethane, 3,5-diethyl-3'-methyl-2',4-diaminodiphenylmethane, 3,5-diisopropyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraisopropyl-4,4'-diaminobenzophenone, 3,3',5,5'-tetraethyl-4,4'-diaminodiphenyl ether, 3,3',5,5'-tetraisopropyl-4,4'-diaminodiphenyl sulfone, and two or more of these as being used together.

Aromatic polyamine having an electron-withdrawing group (such as halogen atoms such as Cl, Br, I, and F, an alkoxy group such as a methoxy group and an ethoxy group, and a nitro group) is exemplified, for example, by methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromo-diphenylmethane, 3,3'-dichlorobenzidine, 3,3'-dimethoxybenzidine, bis(4-amino-3-chlorophenyl) oxide, bis(4-amino-2-chlorophenyl) propane, bis(4-amino-2-chlorophenyl)sulfone, bis(4-amino-3-methoxy phenyl)decane, bis(4-aminophenyl)sulfide, bis(4-aminophenyl)telluride, bis(4-aminophenyl)selenide, bis(4-amino-3-methoxyphenyl) disulfide, 4,4'-methylenebis(2-iodoaniline), 4,4'-methylenebis(2-bromoaniline), 4,4'-methylenebis(2-fluoroaniline), 4-aminophenyl-2-chloroaniline, and the like.

Aromatic polyamine having a secondary amino group is exemplified, for example, by polyamine in which a part or entirety of —$NH_2$ in non-substituted aromatic polyamine, aromatic polyamine having an alkyl group, and aromatic polyamine having an electron-withdrawing group has been substituted with —NH—R' (R' representing an alkyl group, and for example, representing a lower alkyl group such as a methyl group and an ethyl group having a carbon number from 1 to 4) [such as 4,4'-di(methylamino)diphenylmethane or 1-methyl-2-methylamino-4-aminobenzene], polyamide polyamine; low-molecular-weight polyamide polyamine obtained by condensation of dicarboxylic acid (such as a dimer acid) and an excess (at least 2 moles per 1 mole of acid) of polyamines (such as alkylenediamine above or polyalkylenepolyamine); polyether polyamine; a hydride of a cyanoethylated product of polyether polyol (such as polyalkylene glycol); or the like.

Polythiol (16) is exemplified, for example, by alkane dithiol having a carbon number from 2 to 36 (such as ethanedithiol, 1,4-butanedithiol, and 1,6-hexanedithiol), or the like.

Primary and/or secondary monoamine(s) (17) is/are exemplified, for example, by alkylamine having a carbon number from 2 to 24 (such as ethylamine, n-butyl amine, isobutylamine, diethylamine, or n-butyl-n-dodecyl amine), or the like.

<Epoxy Resin>

An epoxy resin is exemplified, for example, by a ring-opening polymerized product of polyepoxide (18); a polyadduct of polyepoxide (18) and an active hydrogen containing compound [such as water, diol (10), dicarboxylic acid (12), polyamine (15), or polythiol (16)]; a cured product of polyepoxide (18) and acid anhydride of dicarboxylic acid (12); or the like.

Polyepoxide (18) is not particularly limited so long as it has two or more epoxy groups in a molecule. From a point of view of mechanical characteristics of a cured product, a substance having 2 epoxy groups in a molecule is preferred as polyepoxide (18). An epoxy equivalent (a molecular weight per one epoxy group) of polyepoxide (18) is preferably not smaller than 65 and not greater than 1000 and more preferably not smaller than 90 and not greater than 500. When an epoxy equivalent is 1000 or smaller, a cross-linked structure becomes dense so that such physical properties as water resistance, chemical resistance, and mechanical strength of the cured product improve. On the other hand, when an epoxy equivalent is smaller than 65, synthesis of polyepoxide (18) may become difficult.

Polyepoxide (18) is exemplified, for example, by an aromatic polyepoxy compound, an aliphatic polyepoxy compound, and the like.

An aromatic polyepoxy compound is exemplified, for example, by glycidyl ether of polyhydric phenol, glycidyl ester of aromatic polyvalent carboxylic acid, glycidyl aromatic polyamine, a glycidylated product of aminophenol, and the like.

The glycidyl ether of polyhydric phenol is exemplified, for example, by bisphenol F diglycidyl ether; bisphenol A diglycidyl ether; bisphenol B diglycidyl ether; bisphenol AD diglycidyl ether; bisphenol S diglycidyl ether; halogenated bisphenol A diglycidyl; tetrachloro bisphenol A diglycidyl ether; catechin diglycidyl ether; resorcinol diglycidyl ether; hydroquinone diglycidyl ether; pyrogallol triglycidyl ether; 1,5-dihydroxynaphthaline diglycidyl ether; dihydroxybiphenyl diglycidyl ether; octachloro-4,4'-dihydroxybiphenyl diglycidyl ether; tetramethylbiphenyl diglycidyl ether; dihydroxynaphthyl cresol triglycidyl ether; tris(hydroxyphenyl) methane triglycidyl ether; dinaphthyl triol triglycidyl ether; tetrakis(4-hydroxyphenyl) ethane tetraglycidyl ether; p-glycidyl phenyl dimethyl tolyl bisphenol A glycidyl ether; trismethyl-t-butyl-butylhydroxy methane triglycidyl ether; 9,9'-bis(4-hidroxyphenyl)fluorene diglycidyl ether; 4,4'-oxybis(1,4-phenylethyl) tetracresol glycidyl ether; 4,4'-oxybis(1,4-phenyl ethyl) phenyl glycidyl ether; bis(dihydroxynaphthalene)tetra glycidyl ether; glycidyl ether of phenol or a cresol novolac resin; glycidyl ether of a limonene phenol novolac resin; diglycidyl ether obtained from reaction between 2 moles of bisphenol A and 3 moles of epichlorohydrin; polyglycidyl ether of polyphenol obtained from condensation reaction between phenol and glyoxal, glutaraldehyde, or formaldehyde; or polyglycidyl ether of polyphenol obtained from condensation reaction between resorcin and acetone.

The glycidyl ester of aromatic polyvalent carboxylic acid is exemplified, for example, by phthalic acid diglycidyl ester, isophthalic acid diglycidyl ester, terephthalic acid diglycidyl ester, and the like.

Glycidyl aromatic polyamine is exemplified, for example, by N,N-diglycidyl aniline, N,N,N',N'-tetraglycidyl xylylene diamine, N,N,N',N'-tetraglycidyl diphenylmethane diamine, and the like.

Other than the compounds listed above, an aromatic polyepoxy compound is exemplified by triglycidyl ether of p-aminophenol (an example of a glycidylated product of aminophenol); a diglycidyl urethane compound obtained from reaction between tolylene diisocyanate or diphenylmethane diisocyanate and glycidol; a glicidyl group containing polyurethane (pre)polymer obtained from reaction between tolylene diisocyanate or diphenylmethane diisocyanate, glycidol, and polyol; diglycidyl ether of an adduct of AO to bisphenol A; or the like.

An aliphatic polyepoxy compound is exemplified, for example, by a chain aliphatic polyepoxy compound, a cyclic aliphatic polyepoxy compound, and the like.

The aliphatic polyepoxy compound may be a copolymer of diglycidyl ether and glycidyl(meth)acrylate.

A chain aliphatic polyepoxy compound is exemplified, for example, by polyglycidyl ether of polyhydric aliphatic alcohol, polyglycidyl ester of polyvalent fatty acid, glycidyl aliphatic amine, and the like.

The polyglycidyl ether of polyhydric aliphatic alcohol is exemplified, for example, by ethylene glycol diglycidyl ether, propylene glycol diglycidyl ether, tetramethylene glycol diglycidyl ether, 1,6-hexanediol diglycidyl ether, polyethylene glycol diglycidyl ether, polypropylene glycol diglycidyl ether, polytetramethylene glycol diglycidyl ether, neopentyl glycol diglycidyl ether, trimethylolpropane polyglycidyl ether, glycerol polyglycidyl ether, pentaerythritol polyglycidyl ether, sorbitol polyglycidyl ether, polyglycerol polyglycidyl ether, and the like.

The polyglycidyl ester of polyvalent fatty acid is exemplified, for example, by diglycidyl oxalate, diglycidyl maleate, diglycidyl succinate, diglycidyl glutarate, diglycidyl adipate, diglycidyl pimelate, and the like.

Glycidyl aliphatic amine is exemplified, for example, by N,N,N',N'-tetraglycidylhexamethylene diamine or the like.

A cyclic aliphatic polyepoxy compound is exemplified, for example, by trisglycidyl melamine, vinyl cyclohexene dioxide, limonene dioxide, dicyclopentadiene dioxide, bis(2,3-epoxy cyclopentyl)ether, ethylene glycol bisepoxy dicyclopentyl ether, 3,4-epoxy-6-methylcyclohexylmethyl-3',4'-epoxy-6'-methylcyclohexane carboxylate, bis(3,4-epoxy-6-methylcyclohexylmethyl)adipate, bis(3,4-epoxy-6-methylcyclohexylmethyl)butylamine, dimer acid diglycidyl ester, and the like. A cyclic aliphatic polyepoxy compound is also exemplified by a hydrogenated product of the aromatic polyepoxy compound above.

<Polyamide Resin>

A polyamide resin is exemplified, for example, by a ring-opening polymer of lactam, a polycondensed product of aminocarboxylic acid, a polycondensed product of polycarboxylic acid and polyamine, and the like.

<Polyimide Resin>

A polyimide resin is exemplified, for example, by an aliphatic polyimide resin (such as a condensed polymer obtained from aliphatic carboxylic dianhydride and aliphatic diamine), an aromatic polyimide resin (such as a condensed polymer obtained from aromatic carboxylic dianhydride and aliphatic diamine or aromatic diamine), and the like.

<Silicon Resin>

A silicon resin is exemplified, for example, by a compound having in a molecular chain, at least one of silicon-silicon bond, silicon-carbon bond, siloxane bond, and silicon-nitrogen bond (such as polysiloxane, polycarbosilane, or polysilazane)

<Phenol Resin>

A phenol resin is exemplified, for example, by a condensed polymer obtained from phenols (such as phenol, cresol, nonyl phenol, lignin, resorcin, or catechol) and aldehydes (such as formaldehyde, acetaldehyde, or furfural).

<Melamine Resin>

A melamine resin is exemplified, for example, by a condensed product obtained from melamine and formaldehyde.

<Urea Resin>

A urea resin is exemplified, for example, by a polycondensed product obtained from urea and formaldehyde.

<Aniline Resin>

An aniline resin is exemplified, for example, by a product obtained from reaction between aniline and aldehydes in an acidic condition.

<Ionomer Resin>

An ionomer resin is exemplified, for example, by a copolymer of a monomer having polymerizable double bond (such as an α-olefin based monomer or a styrene based monomer) and α,β-unsaturated carboxylic acid (such as acrylic acid, methacrylic acid, maleic acid, itaconic acid, maleic acid monomethyl ester, maleic anhydride, or maleic acid monoethyl ester), in which a part or entirety of carboxylic acid is carboxylate (such as potassium salt, sodium salt, magnesium salt, or calcium salt).

<Polycarbonate Resin>

A polycarbonate resin is exemplified, for example, by a condensed polymer of bisphenols (such as bisphenol A, bisphenol F, or bisphenol S) and phosgene, diester carbonate, or the like.

<Crystallinity and Non-Crystallinity>

The shell resin (a) may be a crystalline resin (a1), a non-crystalline resin (a2), or combination of the crystalline resin (a1) and the non-crystalline resin (a2). From a point of view of fixability of the toner particles (C), the shell resin (a) is preferably the crystalline resin (a1).

"Crystallinity" herein means that a ratio between a softening point of a resin (hereinafter also being denoted as "Tm") and a maximum peak temperature (hereinafter also being denoted as "Ta") of heat of fusion of the resin (Tm/Ta) is not lower than 0.8 and not higher than 1.55 and that a result obtained in differential scanning calorimetry (hereinafter also being denoted as DSC) does not show stepwise change in amount of heat absorption but has a clear heat absorption peak. "Non-crystallinity" herein means that a ratio between Tm and Ta (Tm/Ta) is higher than 1.55. Tm and Ta can be measured with a method below.

A flow tester (capillary rheometer) (such as a trade name: "CFT-500D" manufactured by Shimadzu Corporation) can be used to measure Tm. Specifically, while 1 g of a measurement sample is heated at a temperature increase rate of 6° C./min., a plunger applies load of 1.96 MPa to the measurement sample to thereby extrude the measurement sample from a nozzle having a diameter of 1 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tm.

A differential scanning calorimeter (such as a trade name: "DSC210" manufactured by Seiko Instruments, Inc.) can be used to measure Ta. Specifically, a sample to be used for measurement of Ta is initially subjected to pre-treatment. After the sample is molten at 130° C., a temperature is lowered from 130° C. to 70° C. at a rate of 1.0° C./min., and thereafter a temperature is lowered from 70° C. to 10° C. at a rate of 0.5° C./min. Then, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range not lower than 20° C. and not higher than 100° C. is defined as Ta'. When there are a plurality of heat absorption peaks, a temperature of a peak largest in amount of heat absorption is defined as Ta'. After the sample was stored for 6 hours at (Ta'-10)° C., it is in turn stored for 6 hours at (Ta'-15)° C.

Then, with the DSC method, the sample subjected to the pre-treatment above is cooled to 0° C. at a temperature lowering rate of 10° C./min., a temperature is raised at a temperature increase rate of 20° C./min., change in heat absorption and generation is measured, and relation between an "amount of heat absorption and generation" and a "temperature" is plotted in a graph. A temperature at which an amount of heat absorption attains to a maximum value is defined as a maximum peak temperature (Ta) of heat of fusion.

<Heat of Fusion>

The shell resin (a) desirably satisfies a condition that heat of fusion with DSC of the shell resin (a) satisfies Equations (1) and (2) below:

$$5 \leq H1 \leq 70 \quad (1)$$

$$0.2 \leq H2/H1 \leq 1.0 \quad (2)$$

where H1 represents heat of fusion (J/g) at the time of initial temperature increase with DSC and H2 represents heat of fusion (J/g) at the time of second temperature increase with DSC.

H1 is an index of a rate of melting of the shell resin (a). In general, since a resin having heat of fusion has sharp-melting capability, it can be molten with less energy. Therefore, by selecting a resin having heat of fusion as the shell resin (a), energy required at the time of fixation can be lowered. Therefore, a resin having heat of fusion is preferably selected as the shell resin (a). If heat of fusion which the resin has is too great, it may be difficult to sufficiently melt the resin. Preferably, relation of $6 \leq H1 \leq 65$ is satisfied and more preferably relation of $7 \leq H1 \leq 65$ is satisfied.

H2/H1 in Equation (2) above is an index of a rate of crystallization of the shell resin (a). In general, in a case where particles made of a resin (resin particles) are used as they are molten and thereafter cooled, if crystal components in the resin particles have not been crystallized, such a disadvantage that a resistance value of the resin particles is lowered or the resin particles are plasticized is caused. If such a disadvantage is caused, performance of the resin particles obtained by cooling may be different from performance as originally designed. From the foregoing, it is necessary to quickly crystallize crystal components in the resin particles and to avoid influence on performance of the resin particles. H2/H1 is more preferably not lower than 0.3 and more preferably not lower than 0.4. If a rate of crystallization of the shell resin (a) is high, H2/H1 is close to 1.0 and hence H2/H1 preferably takes a value close to 1.0.

H2/H1 in Equation (2) above does not exceed 1.0 theoretically, however, a value actually measured with DSC may exceed 1.0. Even a case where a value (H2/H1) actually measured with DSC exceeds 1.0 is also assumed to satisfy Equation (2) above.

H1 and H2 can be measured in compliance with "testing methods for heat of transitions of plastics" under JIS-K7122 (1987). Specifically, initially, 5 mg of the shell resin (a) is taken and introduced in an aluminum pan. With a differential scanning calorimetry apparatus (such as a trade name: "RDC220" manufactured by SII Nano Technology Inc. or a trade name: "DSC20" of Seiko Instruments Inc.) and with a rate of temperature increase being set to 10° C./min., a temperature at a heat absorption peak of the shell resin (a) owing to melting (melting point) is measured and an area S1 of a heat absorption peak is found. H1 can be calculated from found area S1 of the heat absorption peak. After H1 is calculated, cooling to 0° C. is carried out with a rate of cooling being set to 90° C./min., thereafter a rate of temperature increase is set to 10° C./min., a temperature at a heat absorption peak of the shell resin (a) owing to melting (melting point) is measured, and an area S2 of a heat absorption peak is found. H2 can be calculated from found area S2 of the heat absorption peak.

<Melting Point>

The shell resin (a) has a melting point preferably not lower than 0° C. and not higher than 220° C., more preferably not lower than 30° C. and not higher than 200° C., and further preferably not lower than 40° C. and not higher than 80° C. From a point of view of particle size distribution of the toner particles (C), and powder fluidity, heat-resistant storage stability, and resistance to stress of the liquid developer (X), the shell resin (a) has a melting point preferably not lower than a temperature at the time of manufacturing of the liquid developer (X). If a melting point of the shell resin is lower than a temperature at the time of manufacturing of the liquid developer, it may be difficult to prevent toner particles from uniting with each other and it may be difficult to prevent the toner particles from breaking. In addition, it may be difficult to achieve a narrow width of distribution in particle size distribution of the toner particles. In other words, variation in particle size of toner particles may be large.

A melting point is herein measured with the use of a differential scanning calorimetry apparatus (a trade name: "DSC20" or "SSC/580" manufactured by Seiko Instruments, Inc.) in compliance with a method defined under ASTM D3418-82.

<Mn (Number-Average Molecular Weight) and Mw (Weight-Average Molecular Weight)>

Mn [obtained from measurement with gel permeation chromatography (hereinafter also being denoted as "GPC")] of the shell resin (a) is preferably not smaller than 100 and not greater than 5000000, preferably not smaller than 200 and not greater than 5000000, and further preferably not smaller than 500 and not greater than 500000.

Mn and Mw of a resin (except for a polyurethane resin) herein are measured under conditions below, with the use of GPC, with regard to a soluble content of tetrahydrofuran (hereinafter also being denoted as "THF").

Measurement Apparatus: "HLC-8120" (a trade name, manufactured by Tosoh Corporation)

Column: "TSKgel GMHXL" (a trade name, manufactured by Tosoh Corporation) (two) and "TSKgel Multipore HXL-M" (a trade name, manufactured by Tosoh Corporation) (one)

Sample Solution: 0.25 mass % of THF solution

Amount of Injection of THF Solution into Column: 100 μl

Flow Rate: 1 ml/min.

Measurement Temperature: 40° C.

Detection Apparatus: Refraction index detector

Reference Material: 12 standard polystyrenes (a trade name: TSK standard POLYSTYRENE manufactured by Tosoh Corporation) (molecular weight: 500, 1050, 2800, 5970, 9100, 18100, 37900, 96400, 190000, 355000, 1090000, 2890000)

Mn and Mw of a polyurethane resin are herein measured under conditions below, with the use of GPC.

Measurement Apparatus: "HLC-8220GPC" (a trade name, manufactured by Tosoh Corporation)

Column: "Guardcolumn α" (one) and "TSKgel α-M" (one)

Sample Solution: 0.125 mass % of dimethylformamide solution

Amount of Injection of Dimethylformamide Solution into Column: 100 μl

Flow Rate: 1 ml/min.

Measurement Temperature: 40° C.

Detection Apparatus: Refraction index detector

Reference Material: 12 standard polystyrenes (a trade name: TSK standard POLYSTYRENE manufactured by Tosoh Corporation) (molecular weight: 500, 1050, 2800, 5970, 9100, 18100, 37900, 96400, 190000, 355000, 1090000, 2890000)

<SP Value>

A solubility parameter herein is denoted as an SP value.

The shell resin (a) has an SP value preferably not smaller than 7 $(cal/cm^3)^{1/2}$ and not greater than 18 $(cal/cm^3)^{1/2}$ and more preferably not smaller than 8 $(cal/cm^3)^{1/2}$ and not greater than 14 $(cal/cm^3)^{1/2}$.

<Shell Particles (A)>

The shell particles (A) in the present embodiment contain the shell resin (a). Any known method can be adopted as a method of manufacturing the shell particles (A), without being particularly limited. For example, a method such as [1] to [7] below can be exemplified.

[1]: The shell resin (a) is crushed with a dry method with the use of a known dry type crusher such as a jet mill.

[2]: Powders of the shell resin (a) are dispersed in an organic solvent, and the resultant product is crushed with a wet method with the use of a known wet type disperser such as a bead mill or a roll mill.

[3]: A solution of the shell resin (a) is sprayed and dried with the use of a spray dryer or the like.

[4]: A poor solvent is added to a solution of the shell resin (a) or the solution is cooled, to thereby supersaturate and precipitate the shell resin (a).

[5]: A solution of the shell resin (a) is dispersed in water or an organic solvent.

[6]: A precursor of the shell resin (a) is polymerized in water with an emulsion polymerization method, a soap-free emulsion polymerization method, a seed polymerization method, a suspension polymerization method, or the like.

[7]: A precursor of the shell resin (a) is polymerized in an organic solvent through dispersion polymerization or the like.

From a point of view of ease in manufacturing of the shell particles (A), among these methods, the method in [4], [6], and [7] is preferred and more preferably the method in [6] and [7] is suitable.

<Core Resin (b)>

The core resin (b) in the present embodiment is required to have an acid group and an acid dissociation constant (hereinafter also denoted as pKa) not smaller than 2.90 and not greater than 8.00.

Though a position of an acid group in a molecular structure of the core resin (b) is not particularly limited, it is preferably located at a terminal of the core resin (b). Here, the terminal of the core resin (b) herein refers to a starting end and a terminal end of a longest repeating structure (main chain) of repeating structures of a constitutional unit within a molecule.

When the core resin (b) has pKa smaller than 2.90, hydrolysis of the shell resin (a) or the core resin (b) may be promoted, and in that case, heat-resistant stability of the toner particles (C) is lowered, which is not preferred.

When the core resin (b) has pKa exceeding 8.00, fixability lowers, which is not preferred in consideration of adaptability to such an application as electrophotography.

Therefore, the resin (b) in the present embodiment is required to have pKa not smaller than 2.90 and not greater than 8.00, preferably not smaller than 2.90 and not greater than 6.00, and more preferably suitably not smaller than 2.92 and not greater than 5.50.

A resin having an acid group, among those exemplified as the shell resins (a), can be employed as the core resin (b) in the present embodiment, and for example, a vinyl resin, a polyester resin, a polyurethane resin, a polyamide resin, a polyimide resin, a phenol resin, and a polycarbonate resin can be exemplified. Among these, a polyester resin, a polyurethane resin, or a polyester resin and a polyurethane resin as being used together can suitably be employed.

(1) Polyester Resin Having Acid Group

For example, a polyester resin obtained by introducing a carboxylic acid by using an acid anhydride which will be described later into a polycondensed product of diol and dicarboxylic acid can be exemplified as the polyester resin having an acid group.

Here, diol is exemplified, for example, by alkylene glycol having a carbon number from 2 to 30 (such as ethylene glycol, 1,2-propylene glycol, 1,3-propylene glycol, 1,4-butanediol, 1,6-hexanediol, octanediol, decanediol, dodecanediol, tetradecanediol, neopentylglycol, or 2,2-diethyl-1,3-propanediol), an adduct (the number of added moles being from 2 to 100) of AO [such as EO, propylene oxide (hereinafter also denoted as "PO", or butylene oxide) to bisphenols having a carbon number from 15 to 30 (such as bisphenol A, bisphenol F, or bisphenol S), and a mixture of an adduct of AO to bisphenols and alkylene glycol, among those exemplified above as diol (10).

Dicarboxylic acid is exemplified, for example, by alkane dicarboxylic acid having a carbon number from 4 to 32 (such as succinic acid, adipic acid, sebacic acid, azelaic acid, dodecane dicarboxylic acid, or octadecane dicarboxylic acid), aromatic dicarboxylic acid having a carbon number from 8 to 20 (such as phthalic acid, isophthalic acid, terephthalic acid, or naphthalene dicarboxylic acid), among those exemplified as dicarboxylic acid (12).

(2) Polyurethane Resin Having Acid Group

A polyurethane resin having an acid group is exemplified by a polyadduct of polyisocyanate (14) and an active hydrogen containing compound {for example, water; polyol [such as diol (10) (including diol having a functional group other than a hydroxyl group) or polyol (11) having valence from 3 to 8 or higher]; polycarboxylic acid [such as dicarboxylic acid (12) or polycarboxylic acid (13) having valence from 3 to 6 or higher]; polyester polyol obtained by polycondensation between polyol and polycarboxylic acid; a ring-opening polymer of lactone having a carbon number from 6 to 12; polyamine (15); and polythiol (16); or use there of as combined}, and an amino group containing polyurethane resin obtained by causing a terminal isocyanate group prepolymer resulting from reaction between polyisocyanate (14) and the active hydrogen containing compound above to react with primary and/or secondary monoamine(s) (17) in parts equal to an isocyanate group of the terminal isocyanate group prepolymer.

(3) Vinyl Resin Having Acid Group

A vinyl resin having an acid group is exemplified by a homopolymer and a copolymer of a monomer having a carboxyl group and polymerizable double bond shown below, a monomer having a sulfo group and polymerizable double bond, and a monomer having a phosphono group and polymerizable double bond shown below.

(3-1) Monomer Having Carboxyl Group and Polymerizable Double Bond

A monomer having a carboxyl group and polymerizable double bond is exemplified, for example, by unsaturated monocarboxylic acid having a carbon number from 3 to 15 [such as (meth)acrylic acid, crotonic acid, isocrotonic acid, or cinnamic acid]; unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid]; monoalkyl (having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester); or the like.

(3-2) Monomer Having Sulfo Group and Polymerizable Double Bond

A monomer having a sulfo group and polymerizable double bond is exemplified, for example, by alkene sulfonic acid having a carbon number from 2 to 14 [such as vinyl sulfonic acid, (meth)allyl sulfonic acid, or methyl vinyl sulfonic acid]; styrene sulfonic acid and an alkyl (having a carbon number from 2 to 24) derivative of styrene sulfonic acid (such as α-methylstyrene sulfonic acid); sulfo(hydroxy)alkyl-(meth)acrylate having a carbon number from 5 to 18 [such as sulfopropyl(meth)acrylate, 2-hydroxy-3-(meth)acryloxy propylsulfonic acid, 2-(meth)acryloyloxyethane sulfonic acid, or 3-(meth)acryloyloxy-2-hydroxypropane sulfonic acid]; sulfo(hydroxy)alkyl(meth)acrylamide having a carbon number from 5 to 18 [such as 2-(meth)acryloylamino-2,2-dimethylethane sulfonic acid, 2-(meth)acrylamide-2-methylpropane sulfonic acid, or 3-(meth)acrylamide-2-hydroxypropane sulfonic acid]; alkyl (having a carbon number from 3 to 18) allylsulfo succinic acid (such as propylallylsulfo succinic acid, butylallylsulfo succinic acid, or 2-ethylhexyl-allylsulfo succinic acid); poly-[n=2 to 30] oxyalkylene (such as oxyethylene, oxypropylene, or oxybutylene; polyoxyalkylene may be a homopolymer of oxyalkylene or a copolymer of oxyalkylene; if polyoxyalkylene is a copolymer of oxyalkylene, it may be a random polymer or a block polymer); sulfate ester of mono(meth)acrylate [such as sulfate ester of poly-(n=5 to 15) oxyethylene monomethacrylate or sulfate ester of poly-(n=5 to 15) oxypropylene monomethacrylate]; a compound expressed with Chemical Formulae (1) to (3) above; or the like.

(3-3) Monomer Having Phosphono Group and Polymerizable Double Bond

A monomer having a phosphono group and polymerizable double bond is exemplified, for example, by (meth)acryloyloxy alkyl phosphate monoester (a carbon number of an alkyl group being from 1 to 24) [such as 2-hydroxyethyl (meth)acryloyl phosphate or phenyl-2-acryloyloxy ethyl phosphate]; (meth)acryloyloxy alkyl phosphonic acid (a carbon number of an alkyl group being from 1 to 24) (such as 2-acryloyloxy ethyl phosphonic acid); or the like.

(4) Polyamide Resin Having Acid Group

A polyamide resin having an acid group is exemplified by a ring-opening polymer of lactam, a polycondensed product of aminocarboxylic acid, a polycondensed product of polycarboxylic acid and polyamine, and the like.

(5) Polyimide Resin Having Acid Group

A polyimide resin having an acid group is exemplified by an aliphatic polyimide resin (such as a polymer obtained from aliphatic carboxylic dianhydride and aliphatic diamine), an aromatic polyimide resin (such as a polymer obtained from aromatic carboxylic dianhydride and aliphatic diamine or aromatic diamine), and the like.

(6) Phenol Resin Having Acid Group

A phenol resin having an acid group is exemplified by a polymer obtained by condensation of phenols (such as phenol, cresol, nonyl phenol, lignin, resorcin, and catechol) and aldehydes (such as formaldehyde, acetaldehyde, and furfural).

(7) Polycarbonate Resin Having Acid Group

A polycarbonate resin having an acid group is exemplified by a polymer obtained by condensation of bisphenols (such as bisphenol A, bisphenol F, and bisphenol S) and phosgene, diester carbonate, or the like.

An acid group can be exemplified by a carboxyl group, a sulfonic acid group, a sulfine group, a phosphonic acid group, and a phosphine group. By selecting as appropriate a type of an acid group, pKa of the core resin (b) can be adjusted. A resin providing an acid value preferably has Mn not smaller than 2000 and not greater than 10000 and has an acid value preferably not smaller than 2 and not greater than 35.

Among the acid groups described above, from a point of view of ease in introduction into a molecule by using acid anhydride, a carboxyl group can suitably be employed.

Such an acid anhydride can be exemplified by propionic anhydride, succinic anhydride, maleic anhydride, phthalic anhydride, tetrahydrophthalic anhydride, hexahydrophthalic anhydride, methyltetrahydrophthalic anhydride, methylhexahydrophthalic anhydride, methylnadic anhydride, hydrogenated methylnadic anhydride, trialkyl tetrahydrophthalic anhydride, methyl cyclohexene tetracarboxylic dianhydride, benzophenone tetracarboxylic dianhydride, ethylene glycol bis-anhydrotrimellitate, glycerin bis(anhydrotrimellitate) monoacetate, dodecenyl succinic anhydride, and chlocendic anhydride. Among these, in consideration of a high reaction speed in introduction of an acid group, propionic anhydride, succinic anhydride, maleic anhydride, phthalic anhydride, tetrahydrophthalic anhydride, hexahydrophthalic anhydride, methyltetrahydrophthalic anhydride, and methylhexahydrophthalic anhydride can suitably be employed, and phthalic anhydride, tetrahydrophthalic anhydride, hexahydrophthalic anhydride, methyltetrahydrophthalic anhydride, and methylhexahydrophthalic anhydride would further be suitable.

<pKa of Core Resin (b)> pKa of the core resin (b) can be calculated in accordance with Equation (3) below:

$$pKa=-\log\{[H_3O^+][(b^-)]/[(b)]\} \quad (3)$$

where $[H_3O^+]$ represents a concentration (mol/L) of hydrogen ions at the time when the core resin (b) is dispersed in water, $[(b^-)]$ represents a concentration (mol/L) of a conjugate base at the time when the core resin (b) is dispersed in water, and [(b)] represents a concentration (mol/L) of the core resin (b) at the time when the core resin (b) is dispersed in water.

In the present embodiment, when an acid is dissociated from the core resin (b) in multiple steps, pKa is defined as an acid dissociation constant in the first step.

Mn, a melting point, a glass transition point (hereinafter also denoted as Tg), and an SP value of the core resin (b) can be adjusted in a suitable range in accordance with applications.

For example, in a case where the liquid developer (X) according to the present embodiment is employed for electrophotography, electrostatic recording, or the like, the core resin (b) has Mn preferably not smaller than 1000 and not greater than 5000000 and suitably more preferably not smaller than 2000 and not greater than 500000. In this case, a melting point is preferably not lower than 20° C. and not higher than 300° C. and more preferably not lower than 80° C. and not higher than 250° C. In this case, Tg is preferably not lower than 20° C. and not higher than 200° C. and more preferably not lower than 40° C. and not higher than 150° C. In this case, an SP value is preferably not smaller than 8 $(cal/cm^3)^{1/2}$ and not greater than 16 $(cal/cm^3)^{1/2}$ and more preferably not smaller than 9 $(cal/cm^3)^{1/2}$ and not greater than to 14 $(cal/cm^3)^{1/2}$.

<Method of Measuring Tg>

Tg may be measured with the DSC method or with a flow tester. In a case where Tg is measured with the DSC method, for example, a differential scanning calorimetry apparatus (a trade name: "DSC20", "SSC/580", or the like manufactured by Seiko Instruments, Inc.) is preferably used to measure Tg in compliance with a method defined under ASTM D3418-82.

In a case where Tg is measured with a flow tester, a flow tester (capillary rheometer) (for example, a trade name: "CFT-500 type" manufactured by Shimadzu Corporation) is preferably employed. One example of conditions of measurement of Tg in this case is shown below.

Load: 3 MPa

Rate of Temperature Increase: 3.0° C./min.

Die Diameter: 0.50 mm

Die Length: 10.0 mm

<Core Particles (B)>

The core particles (B) in the present embodiment contain the core resin (b). The core particles (B) can be manufactured from the core resin (b) with a method the same as the method of manufacturing the shell particles (A).

<Toner Particles (C)>

The toner particles (C) according to the present embodiment have such a core-shell structure that the shell particles (A) containing the shell resin (a) may be attached to or cover surfaces of the core particles (B) containing the core resin (b). Here, to cover means continuous attachment of the shell particles (A) to form an object like a film.

The shell particles (A) are preferably smaller in particle size than the core particles (B). From a point of view of uniformity in particle size of the toner particles (C), a particle size ratio [(volume average particle size of shell particles (A))/(volume average particle size of core particles (B))] is preferably within a range not smaller than 0.001 and not greater than 0.3. More preferably, the lower limit of the particle size ratio is 0.003 and the upper limit thereof is 0.25. When the particle size ratio is higher than 0.3, the shell particles (A) are less likely to efficiently adsorb to the surfaces of the core particles (B), and hence a width of distribution in particle size distribution of the obtained toner particles (C) tends to be great. On the other hand, when the particle size ratio is lower than 0.001, manufacturing of the shell particles (A) may become difficult.

In order to achieve a particle size suited to obtain toner particles (C) having a desired particle size and to accommodate a particle size ratio within the preferred range above, a volume average particle size of the shell particles (A) can be adjusted as appropriate. A volume average particle size of the shell particles (A) is preferably not smaller than 0.0005 μm and not greater than 30 μm. The upper limit of the volume average particle size of the shell particles (A) is more preferably 20 μm and further preferably 10 μm. The lower limit of the volume average particle size of the shell particles (A) is more preferably 0.01 μm, further preferably 0.02 μm, and most preferably 0.04 μm. For example, in a case where toner particles (C) having a volume average particle size of 1 μm are desirably obtained, the shell particles (A) have a volume average particle size preferably not smaller than 0.0005 μm and not greater than 0.3 μm and more preferably not smaller than 0.001 μm and not greater than 0.2 μm. For example, in a case where toner particles (C) having a volume average particle size of 10 μm are desirably obtained, the shell particles (A) have a volume average particle size preferably not smaller than 0.005 μm and not greater than 3 μm and more preferably not smaller than 0.05 μm and not greater than 2 μm. For example, in a case where toner particles (C) having a volume average particle size of 100 μm are desirably obtained, the shell particles (A) have a volume average particle size preferably not smaller than 0.05 μm and not greater than 30 μm and more preferably not smaller than 0.1 μm and not greater than 20 μm.

From a point of view of ease in control of the particle size ratio within the preferred range, the core particles (B) have the volume average particle size preferably not smaller than 0.1 μm and not greater than 300 μm, more preferably not smaller than 0.5 μm and not greater than 250 μm, and further preferably not smaller than 1 μm and not greater than 200 μm.

<Method of Measuring Volume Average Particle Size>

The "volume average particle size" herein can be measured by using a laser particle size distribution analyzer (for example, a trade name: "LA-920" manufactured by Horiba, Ltd. or a trade name "Multisizer III" manufactured by Beckman Coulter) and a measurement apparatus (a trade name: "ELS-800" manufactured by Otsuka Electronics Co., Ltd.) using a laser Doppler method as an optical system. If different measurement apparatuses measure a volume average particle size and there is a difference between measurement values, a measurement value obtained by "ELS-800" is adopted.

A mass ratio between the shell particles (A) and the core particles (B) [(A):(B)] is preferably from 1:99 to 70:30. From a point of view of uniformity in a particle size of toner particles (C), heat-resistant stability of the liquid developer (X), the ratio [(A):(B)] above is more preferably from 2:98 to 50:50 and further preferably from 3:97 to 35:65. When a content (a mass ratio) of the shell particles is too low, blocking resistance of the toner particles may lower. When a content (a mass ratio) of the core particles is too high, fixability at a low temperature may become poor.

From a point of view of fluidity, a melt leveling characteristic, and the like of the liquid developer (X), the toner particles (C) preferably have a spherical shape. Specifically, an average value of circularity of the toner particles (C) (average circularity) is preferably not smaller than 0.92 and not greater than 1.0, more preferably not smaller than 0.97 and not greater than 1.0, and further preferably not smaller than 0.98 and not greater than 1.0. As average circularity of the toner particles (C) is closer to 1.0, the toner particles (C) have a shape closer to a sphere. When the core particles (B) are spherical, the toner particles (C) tend to be spherical and hence the core particles (B) are preferably spherical.

<Method of Measuring Average Circularity>

Average circularity herein is a value obtained by optically sensing the toner particles (C) and dividing a circumferential length of a circle equal in area to a projection area of the toner particles (C) by a circumferential length of the sensed toner particles (C). Specifically, average circularity is measured with a flow particle image analyzer (for example, a trade name; "FPIA-3000" manufactured by Sysmex Corporation). Specifically, water not less than 100 ml and not more than 150 ml, from which an impure solid has been removed in advance, is introduced in a prescribed container, a surfactant not less than 0.1 ml and not more than 0.5 ml (for example, a trade name: "Drywell" manufactured by Fujifilm Corporation) is added as a dispersant, and a measurement sample approximately not less than 0.1 g and not more than 9.5 g is further added. A suspension in which a measurement sample was thus dispersed is subjected to dispersion treatment for a period approximately not shorter than 1 minute and not longer than 3 minutes with the use of an ultrasonic disperser (for example, a trade name: "Ultrasonic Cleaner Model VS-150" manufactured by Velvo-Clear). Thus, a dispersion concentration is not less than 3000/μL and not more than 10000/μL. A shape and particle size distribution of the measurement sample are measured, with the use of the sample solution subjected to dispersion treatment.

Though the volume average particle size of the toner particles (C) is preferably determined as appropriate depending on applications, it is generally preferably not smaller than 0.01 μm and not greater than 100 μm. The upper limit of the volume average particle size of the toner particles (C) is more preferably 40 μm, further preferably 30 μm, and most preferably 20 μm. The lower limit of the volume average particle size of the toner particles (C) is more preferably 0.3 μm and further preferably 0.5 μm.

From a point of view of uniformity in particle size of the toner particles (C), a coefficient of variation of volume distribution of the toner particles (C) is preferably not lower than 1% and not higher than 100%, more preferably not lower than 1% not higher than 50%, further preferably not lower than 1% and not higher than 30%, and most preferably not lower than 1% and not higher than 25%. A coefficient of variation of volume distribution herein is measured with such a particle size distribution analyzer as a laser particle size distribution analyzer (for example, a trade name: "LA-920" manufactured by Horiba, Ltd.).

<Ratio of Surface Coverage>

From a point of view of uniformity in particle size of the toner particles (C), fluidity of the liquid developer (X), and heat-resistant stability of the liquid developer (X), a ratio of surface coverage of the core particles (B) with the shell particles (A) in the toner particles (C) is preferably not lower than 50% and more preferably not lower than 80%. Surface coverage of the core particles (B) with the shell particles (A) means that the shell particles (A) are attached to outermost surfaces of the core particles (B) or the shell particles (A) are concentrated in the vicinity of the surfaces of the core particles (B) in the toner particles (C) having the core-shell structure. Though a state of presence (a way of presence) of the shell particles (A) and the core particles (B) in the toner particles (C) is different depending on a composition of the shell resin (a) and the core resin (b) or a method of manufacturing the toner particles (C), some shell resin (a) may be present in the core resin (b) and some shell resin (a) may be present on the surfaces of the core particles (B). The ratio of surface coverage of the core particles (B) with the shell particles (A) can be found, for example, based on an Equation (4) below, from analysis of an image obtained by a scanning electron microscope (SEM). By changing a ratio of surface coverage found in Equation (4) below, a shape of the toner particles (C) can be controlled.

$$\text{Surface coverage ratio}(\%)=\{S1/(S1+S2)\}\times 100 \quad (4)$$

(where S1 represents an area of the core particles (B) covered with the shell particles (A), and S2 represents an area of the core particles (B) to which the shell particles (A) are not attached or which are not covered with the shell particles (A)).

A surface coverage ratio herein is defined by an average value of results of measurement of 50 particles.

From a point of view of fluidity of the liquid developer (X), surface center line average roughness (Ra) of the toner particles (C) is preferably not smaller than 0.01 μm and not greater than 0.8 μm Surface center line average roughness (Ra) is a value obtained by calculating an arithmetic mean of absolute values of deviations between a roughness curve and a center line of the roughness curve, and it is measured with a scanning probe microscope system (for example, manufactured by Toyo Corporation) or the like.

From a point of view of particle size distribution of the toner particles (C) and heat-resistant stability of the liquid developer (X), the core-shell structure of the toner particles (C) is preferably composed of the shell particles (A) formed like a film not lower than 1 mass % and not higher than 70 mass % (more preferably not lower than 5 mass % and not higher than 50 mass % and further preferably not lower than 10 mass % and not higher than 35 mass %) and the core particles (B) not lower than 30 mass % and not higher than 99 mass % (more preferably not lower than 50 mass % and not higher than 95 mass % and further preferably not lower than 65 mass % and not higher than 90 mass %) with respect to a mass of the toner particles (C).

From a point of view of fixability of the toner particles (C) and heat-resistant stability of the liquid developer (X), a content of the toner particles (C) in the liquid developer (X) is preferably not lower than 10 mass % and not higher than 50 mass %, more preferably not lower than 15 mass % and not higher than 45 mass %, and further preferably not lower than 20 mass % and not higher than 40 mass %.

<Additive>

The toner particles (C) in the present embodiment preferably contain a coloring agent in at least one of the shell particles (A) and the core particles (B), and further preferably, the core particles (B) contain the core resin (b) and a coloring agent. The toner particles (C) may further contain in at least one of the shell particles (A) and the core particles (B), an additive other than the coloring agent (such as a wax, a filler, an antistatic agent, a release agent, a charge control agent, a UV absorber, an antioxidant, an antiblocking agent, a heat-resistant stabilization agent, and a fire retardant).

<Coloring Agent>

Though a known pigment can be employed as a coloring agent without being particularly limited, from a point of view of cost, light resistance, coloring capability, and the like, coloring agents shown below are preferably employed. In terms of color construction, coloring agents shown below are normally categorized into a black pigment, a yellow pigment, a magenta pigment, and a cyan pigment, and colors (color images) other than black are basically toned by subtractive color mixture of a yellow pigment, a magenta pigment, and a cyan pigment. The coloring agent may be obtained by subjecting a pigment shown below to surface treatment with the use of a solvent which is acidic, basic, or the like. For example, an acidic or basic synergist may be used together with pigments shown below.

A black pigment is exemplified, for example, by carbon black.

A yellow pigment is exemplified, for example, by a disazo based yellow pigment such as C. I. (color index) Pigment Yellow 12, 13, 14, 17, 55, 81, 83, 180, and 185.

A magenta pigment is exemplified, for example, by an azo lake based magenta pigment such as C. I. Pigment Red 48, 57 (carmine 6B), 5, 23, 60, 114, 146, and 186; an insoluble azo based magenta pigment; a thioindigo based magenta pigment such as C. I. Pigment Red 88, and C. I. Pigment Violet 36 and 38; a quinacridone based magenta pigment such as C. I. Pigment Red 122 and 209; a naphtol based magenta pigment such as C I. Pigment Red 269; or the like. As a magenta pigment, at least one of a quinacridone based pigment, a carmine based pigment, and a naphtol based pigment is preferably contained among these, and more preferably, two or three types of these three types of pigments are suitably contained.

A cyan pigment is exemplified, for example, by a copper phthalocyanine blue based cyan pigment such as C. I. Pigment Blue 15:1 or 15:3; a phthalocyanine green based pigment; or the like.

<Wax>

The core particles (B) preferably contain at least one of a wax (c) and a modified wax (d) obtained by graft polymerization of a vinyl polymer chain with the wax. The shell particles (A) may contain at least one of the wax (c) and the modified wax (d).

From a point of view of heat-resistant stability of the liquid developer (X), at least one of a wax (c) and a modified wax (d) obtained by graft polymerization of a vinyl polymer chain with the wax is preferably contained in the core particles (B) (a core layer) as an additive.

A content of the wax (c) is preferably not higher than 20 mass % and more preferably not lower than 1 mass % and not higher than 15 mass % with respect to the mass of the core particles (B). A content of the modified wax (d) is preferably not higher than 10 mass % and more preferably not lower than 0.5 mass % and not higher than 8 mass % with respect to the mass of the core particles (B). A total content of the wax (c) and the modified wax (d) in a case that both of the wax (c) and the modified wax (d) are contained is preferably not higher than 25 mass % and more preferably not lower than 1 mass % and not higher than 20 mass % with respect to the mass of the core particles (B).

The wax (c) is exemplified, for example, by a synthetic wax (such as a polyolefin wax); a natural wax (such as a paraffin wax, a microcrystalline wax, a carnauba wax, a carbonyl group containing wax, or combination thereof); or the like. Among these, the paraffin wax and the carnauba wax are preferred as the wax (c). The paraffin wax is exemplified, for example, by a petroleum based wax having a melting point not lower than 50° C. and not higher than 90° C. and mainly composed of straight-chain saturated hydrocarbon having a carbon number from 20 to 36. The carnauba wax is exemplified, for example, by a plant and animal wax having a melting point not lower than 50° C. and not higher than 90° C. and a carbon number from 16 to 36.

From a point of view of a release characteristic, Mn of the wax (c) is preferably not smaller than 400 and not greater than 5000, more preferably not smaller than 1000 and not greater than 3000, and further preferably not smaller than 1500 and not greater than 2000. Mn of the wax (c) is herein measured with GPC. At the time of measurement of Mn of the wax (c), for example, o-dichlorobenzene can be employed as a solvent, and for example, polystyrene can be employed as a reference material.

In combined use of the wax (c) and the modified wax (d), the wax (c) is preferably dispersed, together with the modified wax (d), in the core resin (b) after it is subjected to treatment of at least one of melting, kneading, and mixing treatment in the absence of a solvent and heating, dissolving, and mixing treatment in the presence of an organic solvent. By thus allowing the modified wax (d) to coexist at the time of dispersion treatment of the wax, a wax group portion of the modified wax (d) efficiently adsorbs to the surface of the wax (c) or a part of a wax group portion of the modified wax (d) is efficiently entangled with the inside of a matrix structure of the wax (c). Thus, affinity between the surface of the wax (c) and the core resin (b) is better, so that the wax (c) can more uniformly be encapsulated in the core particles (B). Therefore, control of a dispersed state of the wax (c) is facilitated.

A wax used for the modified wax (d) is exemplified, for example, by those the same as listed as specific examples of the wax (c). A preferred material for the wax used for the modified wax (d) is also exemplified by those the same as listed as preferred materials for the wax (c). A monomer having polymerizable double bond is exemplified, for example, by those the same as the monomers (1) to (9) having polymerizable double bond forming the vinyl resin above. The monomer (1), the monomer (2), and the monomer (6) are preferred among these. As a monomer having polymerizable double bond, any of the monomers (1) to (9) above may be used alone, or two or more of them may be used together.

An amount of a wax component (including unreacted wax) in the modified wax (d) is preferably not lower than 0.5 mass % and not higher than 99.5 mass %, more preferably not lower than 1 mass % and not higher than 80 mass %, further preferably not lower than 5 mass % and not higher than 50 mass %, and most preferably not lower than 10 mass % and not higher than 30 mass %.

From a point of view of heat-resistant stability of the liquid developer (X), Tg of the modified wax (d) is preferably not lower than 40° C. and not higher than 90° C. and more preferably not lower than 50° C. and not higher than 80° C.

Mn of the modified wax (d) is preferably not smaller than 1500 and not greater than 10000 and more preferably not smaller than 1800 and not greater than 9000. If Mn of the modified wax (d) is not smaller than 1500 and not greater than 10000, mechanical strength of the toner particles (C) is good.

A method of manufacturing such a modified wax (d) is not particularly limited. For example, the modified wax (d) can be obtained by dissolving or dispersing the wax (c) in a solvent (such as toluene or xylene), heating the resultant solution to a temperature not lower than 100° C. and not higher than 200° C., thereafter polymerizing a monomer having polymerizable double bond, and then distilling out the solvent.

A method of mixing the wax (c) and the modified wax (d) can be exemplified, for example, by a method described in [i] to [iii] below. Among [i] to [iii] below, [ii] is preferably employed.

[i]: Melting the wax (c) and the modified wax (d) at a temperature not lower than a melting point of each of them and mixing and kneading the same.

[ii]: Dissolving or suspending the wax (c) and the modified wax (d) in an organic solvent (u) which will be described later, and thereafter precipitating the same in a liquid through cooling crystallization, solvent crystallization, or the like, or precipitating the same in a gas through spray drying or the like.

[iii]: Dissolving or suspending the wax (c) and the modified wax (d) in an organic solvent (u) which will be described later, and thereafter mechanically crushing the same with a dry method with the use of a disperser or the like.

A method of dispersing the wax (c) and/or the modified wax (d) in the core resin (b) is exemplified, for example, by a method of dissolving or dispersing the wax (c) and/or the modified wax (d) as well as the core resin (b) in respective solvents and then mixing them.

<Insulating Liquid (L)>

The insulating liquid (L) can be exemplified, for example, by aliphatic hydrocarbon, alicyclic hydrocarbon, aromatic hydrocarbon, halogenated hydrocarbon, or polysiloxane. Specifically, hexane, octane, isooctane, decane, isodecane, decalin, nonane, dodecane, isododecane, cyclohexane, cyclooctane, cyclodecane, benzene, toluene, xylene, and mesitylene can be enumerated, and more specifically, for example, Isopar E, Isopar G, Isopar H, and Isopar L ("Isopar" being a trade name of Exxon Mobil Corporation), Shellsol 70 and Shellsol 71 ("Shellsol" being a trade name of Shell Oil Company), Amsco OMS and Amsco 460 ("Amsco" being a trade name of American Mineral Spirits Company), IP Solvent 2028 (a trade name of Idemitsu Kosan Co., Ltd.), silicone oil, and liquid paraffin can be enumerated. These may be used alone, or two or more of them may be used together.

From a point of view of odor, what is preferred as the insulating liquid (L) among these is a solvent having a boiling point not lower than 100° C., and what is more preferred is a hydrocarbon based solvent having a carbon number not smaller than 10 (such as dodecane, isodedecane, and liquid paraffin) and silicone oil, and what is further preferred is liquid paraffin.

The insulating liquid (L) preferably has a relative dielectric constant at 20° C., not lower than 1 and not higher than 4. Thus, charge maintainability of the liquid developer can be enhanced. A relative dielectric constant of the insulating liquid (L) is calculated by using a dielectric constant of the insulating liquid (L) found with a bridge method (JIS C2101-1999). Specifically, a capacitance $C_0$ (pF) in an empty state before filling with the insulating liquid (L) and an equivalent parallel capacitance $C_x$ (pF) in a state filled with the insulating liquid (L) are measured, which are substituted into Equation (5) below, to thereby calculate a dielectric constant ε of the insulating liquid (L). A relative dielectric constant of the insulating liquid (L) is found based on a ratio between calculated a and a relative dielectric constant 1.000585 of air.

$$\varepsilon = C_x / C_0 \quad (5)$$

Preferably, a solvent contained in the liquid developer (X) according to the present embodiment is substantially the insulating liquid (L) alone. The liquid developer (X), however, may contain other organic solvents, in a range preferably not higher than 1 mass % and more preferably not higher than 0.5 mass %.

<Method for Manufacturing Liquid Developer>

Though a method for manufacturing the liquid developer (X) according to the present embodiment is not particularly limited, manufacturing with the manufacturing method according to the present embodiment is particularly preferred because particle size distribution of the toner particles (C) in the liquid developer (X) can be narrow.

The manufacturing method according to the present embodiment includes the following steps [I] to [IV].

Step [I]: Preparing a dispersion liquid (W) of the shell particles (A) obtained by dispersing the shell particles (A) containing the shell resin (a) in the insulating liquid (L)

Step [II]: Preparing a solution for forming the core particles (B) in which the core resin (b) or a precursor (b0) of the core resin (b) has been dissolved in an organic solvent (M)

Step [III]: Forming the core particles (B) containing the core resin (b) in the dispersion liquid (W) by dispersing the solution for forming the core particles (B) in the dispersion liquid (W) of the shell particles (A) and obtaining the toner particles (C) having the core-shell structure that the shell particles (A) are attached to or cover surfaces of the core particles (B)

Step [IV]: Obtaining the liquid developer (X) by distilling out the organic solvent (M) after the step of obtaining the toner particles (C)

The core resin (b) has an acid group and an acid dissociation constant not smaller than 2.90 and not greater than 8.00.

The method for manufacturing a liquid developer according to the present embodiment preferably includes a step [V] below.

Step [V]: Preparing a dispersion liquid in which a coloring agent has been dispersed (a dispersion liquid of a coloring agent)

By omitting the step [I] and dispersing a liquid mixture obtained by adding the shell resin (a) into the solution for forming the core particles (B) adjusted in advance in the step [II] in the insulating liquid (L) instead of dispersing the solution for forming the core particles (B) in the dispersion liquid (W) in the step [III], the core particles (B) containing the core resin (b) can be formed and the toner particles (C) having the core-shell structure that the shell particles (A) are attached to or cover surfaces of the core particles (B) can be obtained.

Detailed description for each step will be given below.

<Step [I]>

In the step [I], the dispersion liquid (W) can be manufactured by manufacturing the shell particles (A) and then dispersing the shell particles (A) in the insulating liquid (L), however, the method is not particularly limited.

In a case where the shell particles (A) are manufactured and then the shell particles (A) are dispersed in the insulating liquid (L), a method in any of [4] to [6] below is preferably employed and [6] below is more preferably employed. In a case where the shell particles (A) are manufactured through polymerization reaction or the like in the insulating liquid (L), a method in any of [1] to [3] below is preferably employed and [1] below is more preferably employed.

[1]: When the shell resin (a) is a vinyl resin, a monomer is polymerized in a solvent containing the insulating liquid (L) with a dispersion polymerization method or the like. Thus, a dispersion liquid (W1) of the shell particles (A) is directly manufactured. As necessary, a solvent other than the insulating liquid (L) is distilled out of the dispersion liquid (W) of the shell particles (A). In distilling out a solvent other than the insulating liquid (L), a low-boiling-point component in the insulating liquid (L) may be distilled out. This is also the case in the step of distilling out a solvent other than the insulating liquid (L) shown below.

[2]: When the shell resin (a) is a polyaddition resin or a condensed-type resin such as a polyester resin or a polyurethane resin, a precursor (a monomer, an oligomer, or the like) or a solution of the precursor is dispersed in the insulating liquid (L) in the presence of an appropriate dispersant as necessary and thereafter the precursor is cured by heating, addition of a curing agent, or the like. As necessary, a solvent other than the insulating liquid (L) is distilled out.

[3]: When the shell resin (a) is a polyaddition resin or a condensed-type resin such as a polyester resin or a polyurethane resin, an appropriate emulsifier is dissolved in a precursor (a monomer, an oligomer, or the like) or a solution of the precursor (a starting material is preferably a liquid, however, it may be a material liquefied by heating), and thereafter the insulating liquid (L) serving as a poor solvent is added thereto, to thereby re-precipitate the precursor. Thereafter, the precursor is cured by addition of a curing agent or the like, and as necessary, a solvent other than the insulating liquid (L) is distilled out.

[4]: The shell resin (a) obtained by polymerization reaction in advance (any polymerization reaction such as addition polymerization, ring-opening polymerization, polyaddition, addition condensation, and condensation polymerization may be acceptable, which is also the case with [5] and [6] below) is crushed with a pulverizer of a mechanical rotation type or a jet type and thereafter classified. The shell particles (A) are thus obtained. The obtained shell particles (A) are dispersed in the insulating liquid (L) in the presence of an appropriate dispersant.

[5]: A resin solution in which the shell resin (a) obtained through polymerization reaction in advance has been dissolved (this resin solution may be a solution obtained by polymerizing the shell resin (a) in a solvent) is sprayed in mist. The shell particles (A) are thus obtained. The obtained shell particles (A) are dispersed in the insulating liquid (L) in the presence of an appropriate dispersant.

[6]: By adding a poor solvent (preferably the insulating liquid (L)) to a resin solution in which the shell resin (a) obtained through polymerization reaction in advance has been dissolved (this resin solution may be a solution obtained by polymerizing the shell resin (a) in a solvent) or by cooling a resin solution obtained by heating and dissolving the shell resin (a) in advance, and further by causing an appropriate dispersant to exist, the shell particles (A) are precipitated. As necessary, a solvent other than the insulating liquid (L) is distilled out.

In a case where the shell particles (A) are manufactured and then the shell particles (A) are dispersed in the insulating liquid (L), a method of manufacturing the shell particles (A) is not particularly limited. A method of manufacturing the shell particles (A) in a dry method shown in [7] below may be employed, or a method of manufacturing the shell particles (A) in a wet method shown in [8] to [13] below may be employed. From a point of view of ease in manufacturing of the shell particles (A), a method of manufacturing the shell particles (A) is preferably a wet method, more preferably [10] below, [12] below, or [13] below, and further preferably [12] or [13] below.

[7]: The shell resin (a) is crushed with a dry method with the use of a known dry type crusher such as a jet mill.

[8]: Powders of the shell resin (a) are dispersed in an organic solvent, and the resultant product is crushed with a wet method with the use of a known wet type disperser such as a bead mill or a roll mill.

[9]: A solution of the shell resin (a) is sprayed and dried with the use of a spray dryer or the like.

[10]: A poor solvent is added to a solution of the shell resin (a) or the solution is cooled, to thereby supersaturate and precipitate the shell resin (a).

[11]: A solution of the shell resin (a) is dispersed in water or an organic solvent.

[12]: A precursor of the shell resin (a) is polymerized in water with an emulsion polymerization method, a soap-free emulsion polymerization method, a seed polymerization method, a suspension polymerization method, or the like.

[13]: A precursor of the shell resin (a) is polymerized in an organic solvent through dispersion polymerization or the like.

A dispersant in [2] and [4] to [6] above is exemplified, for example, by a known surfactant (s), an oil-soluble polymer (t), and the like. As an adjuvant for dispersion, for example, an organic solvent (u), a plasticizer (v), and the like can be used together.

The surfactant (s) is exemplified, for example, by an anionic surfactant (s-1), a cationic surfactant (s-2), an amphoteric surfactant (s-3), a nonionic surfactant (s-4), and the like. Two or more surfactants may be used together as the surfactant (s).

The anionic surfactant (s-1) is exemplified, for example, by ether carboxylic acid (carboxylate) having an alkyl group having a carbon number from 8 to 24 [such as (poly) oxyethylene (the number of repeating units being from 1 to 100) lauryl ether sodium acetate]; ether sulfuric acid ester salt having an alkyl group having a carbon number from 8 to 24 [such as (poly)oxyethylene (the number of repeating units being from 1 to 100) sodium lauryl sulfate]; sulfo succinic acid ester salt having an alkyl group having a carbon number from 8 to 24 [such as mono- or di-alkyl sulfosuccinic acid ester sodium, mono- or di-alkyl sulfosuccinic acid ester disodium, (poly)oxyethylene (the number of repeating units being from 1 to 100) mono- or di-alkyl sulfosuccinic acid ester sodium, or (poly)oxyethylene (the number of repeating units being from 1 to 100) mono- or di-alkyl sulfosuccinic acid ester disodium]; (poly)oxyethylene (the number of repeating units being from 1 to 100) coconut oil fatty acid monoethanol sodium amidosulfate; sulfonate having an alkyl group having a carbon number from 8 to 24 (such as sodium dodecylbenzenesulfonate); phosphate salt having an alkyl group having a carbon number from 8 to 24 [such as sodium lauryl phosphate or (poly)oxyethylene (the number of repeating units being from 1 to 100) lauryl ether sodium phosphate]; fatty acid salt (such as sodium laurate or triethanolamine laurate); acylated amino acid salt (such as coconut oil fatty acid methyltaurine sodium); or the like.

The cationic surfactant (s-2) is exemplified, for example, by a cation surfactant of a quaternary ammonium salt type, a cation surfactant of an amine salt type, and the like. The cation surfactant of the quaternary ammonium salt type is exemplified, for example, by a compound obtained by reaction between tertiary amines and a quaternization agent (such as halogenated alkyl such as methyl chloride, methyl bromide, ethyl chloride, and benzyl chloride, dimethyl sulfate, dimethyl carbonate, or ethyleneoxide), or the like. A specific example of the cation surfactant of the quaternary ammonium salt type is exemplified, for example, by didecyldimethyl ammonium chloride, stearyl trimethyl ammonium bromide, lauryl dimethylbenzyl ammonium chloride (benzalkonium chloride), polyoxyethylene trimethyl ammonium chloride, stearamide ethyl diethyl methyl ammonium methosulfate, and the like.

The cation surfactant of the amine salt type is exemplified, for example, by a compound obtained by neutralizing primary to tertiary amines with an inorganic acid (such as hydrochloric acid, nitric acid, sulfuric acid, or hydriodic acid) or an organic acid (such as acetic acid, formic acid, oxalic acid, lactic acid, gluconic acid, adipic acid, or alkyl phosphate), or the like. The cation surfactant of the primary amine salt type is exemplified, for example, by an inorganic acid salt of aliphatic higher amine (higher amine such as lauryl amine, stearyl amine, cured tallow amine, or rosin amine) or an organic acid salt thereof; higher fatty acid (such as stearic acid or oleic acid) salt of lower amines; or the like. The cation surfactant of the secondary amine salt type is exemplified, for example, by an inorganic acid salt of aliphatic amine such as an adduct of ethylene oxide to aliphatic amine, an organic acid salt thereof, or the like.

The amphoteral surfactant (s-3) is exemplified, for example, by a carboxybetaine type amphoteral surfactant [such as fatty acid amide propyl dimethylamino betaine acetate having a carbon number from 10 to 18 (such as coconut oil fatty acid amidopropylbetaine), alkyl (having a carbon number from 10 to 18) dimethylamino betaine acetate (such as lauryl dimethylamino betaine acetate), or imidazolinium type carboxybetaine (such as 2-alkyl-N-carboxymethyl-N-hydroxyethyl imidazolinium betaine)]; a sulfobetaine type amphoteral surfactant [such as fatty acid amide propylhydroxy ethylsulfobetaine having a carbon number from 10 to 18 (such as coconut oil fatty acid amidopropyl dimethylhydroxyethyl sulfobetaine) or dimethyl alkyl (having a carbon number from 10 to 18) dimethylhydroxy ethylsulfobetaine (such as lauryl hydroxysulfobetaine)]; an amino acid type amphoteral surfactant (such as β-laurylamino sodium propionate); or the like.

The nonionic surfactant (s-4) is exemplified, for example, by an AO addition type nonionic surfactant, a polyhydric alcohol type nonionic surfactant, and the like.

The AO addition type nonionic surfactant is exemplified, for example, by an adduct (the number of added moles per active hydrogen being from 1 to 30) of AO (having a carbon number from 2 to 4, preferably 2) to higher alcohol (having a carbon number from 8 to 18); an adduct (the number of added moles being from 1 to 30) of EO to alkyl (having a carbon number from 1 to 12) phenol; an adduct (the number of added moles per active hydrogen being from 1 to 40) of AO (having a carbon number from 2 to 4, preferably 2) to higher amine (having a carbon number from 8 to 22); an adduct (the number of added moles per active hydrogen being from 1 to 60) of EO to fatty acid (having a carbon number from 8 to 18); an adduct (the number of added moles per active hydrogen being from 1 to 50) of EO to polypropylene glycol (Mn=200 to 4000); polyoxyethylene (the number of repeating units being from 3 to 30) alkyl (having a carbon number from 6 to 20) allyl ether; an adduct (the number of added moles per active hydrogen being from 1 to 30) of EO to fatty acid (having a carbon number from 8 to 24) ester of polyhydric (divalent to octavalent or higher) alcohol (having a carbon number from 2 to 30), such as an adduct (the number of added moles per active hydrogen being from 1 to 30) of EO to sorbitan monolaurate and an adduct (the number of added moles per active hydrogen being from 1 to 30) of EO to sorbitan monooleate; and the like.

The polyhydric alcohol type nonionic surfactant is exemplified, for example, by fatty acid (having a carbon number from 8 to 24) ester of polyhydric (divalent to octavalent or higher) alcohol (having a carbon number from 2 to 30), such as glycerol monooleate, sorbitan monolaurate, and sorbitan monooleate; fatty acid (having a carbon number from 10 to 18) alkanolamide such as monoethanolamide laurate and diethanolamide laurate; and the like.

The oil-soluble polymer (t) is exemplified, for example, by a polymer having at least one group of an alkyl group having a carbon number not smaller than 4, a dimethylsiloxane group, and a functional group having a fluorine atom. More preferably, the oil-soluble polymer (t) has at least one group of an alkyl group having affinity with the insulating liquid (L), a dimethylsiloxane group, and a functional group having a fluorine atom, and has a chemical structure having affinity with the core resin (b).

The oil-soluble polymer (t) is more preferably obtained by polymerizing or copolymerizing at least one monomer of a monomer having an alkyl group having a carbon number not smaller than 4, a monomer having a dimethylsiloxane group (or a reactive oligomer), and a monomer having a fluorine atom, among the monomers (1) to (9) having polymerizable double bond above.

The organic solvent (u) may be the insulating liquid (L) or an organic solvent other than the insulating liquid (L) (such as a solvent other than the insulating liquid (L), of organic solvents (M) which will be described later). Since a solvent other than the insulating liquid (L) is distilled out after preparation of the dispersion liquid (W) of the shell particles (A), it is preferably a solvent readily distilled out, and for example, it is preferably lower in boiling point than the insulating liquid (L).

The plasticizer (v) may be added to the insulating liquid (L) as necessary in dispersing the shell particles (A), or may be added to a solvent containing the core resin (b) or the like.

The plasticizer (v) is not particularly limited, and it is exemplified, for example, by a plasticizer shown as plasticizers (v1) to (v6) below.

The plasticizer (v1) is exemplified, for example, by phthalate (such as dibutyl phthalate, dioctyl phthalate, butyl benzyl phthalate, or diisodecyl phthalate).

The plasticizer (v2) is exemplified, for example, by aliphatic dibasic acid ester (such as di-2-ethylhexyl adipate or 2-ethylhexyl sebacate).

The plasticizer (v3) is exemplified, for example, by trimellitate (such as tri-2-ethylhexyl trimellitate or trioctyl trimellitate).

The plasticizer (v4) is exemplified, for example, by phosphate (such as triethyl phosphate, tri-2-ethylhexyl phosphate, or tricresyl phosphate).

The plasticizer (v5) is exemplified, for example, by fatty acid ester (such as butyl oleate).

The plasticizer (v6) is combination of materials listed as the plasticizers (v1) to (v5) above.

<Step [II]>

In the step [II], the solution for forming the core particles (B) is prepared by dissolving the core resin (b) or the precursor (b0) of the core resin (b) in the organic solvent (M).

A method of dissolving the core resin (b) or the precursor (b0) of the core resin (b) in the organic solvent (M) may be any method and a known method can be employed. For example, a method of introducing the core resin (b) or the precursor (b0) of the core resin (b) in the organic solvent (M) and then stirring the resultant product or a method of introducing the core resin (b) or the precursor (b0) of the core resin (b) in the organic solvent (M) and then heating the resultant product is exemplified.

The organic solvent (M) is not particularly limited so long as it is a solvent capable of dissolving the core resin (b) at room temperature or under heating. The organic solvent (M) has an SP value preferably not smaller than 8.5 $(cal/cm^3)^{1/2}$ and not greater than 20 $(cal/cm^3)^{1/2}$ and more preferably not smaller than 10 $(cal/cm^3)^{1/2}$ and not greater than 19 $(cal/cm^3)^{1/2}$. In a case where a mixed solvent is employed as the organic solvent (M), a weighted average value of SP values calculated from an SP value of each solvent should only be within the range above, assuming that an additive property is ensured. If the SP value of the organic solvent (M) is out of the range above, solubility of the core resin (b) or the precursor (b0) of the core resin (b) may be insufficient.

The organic solvent (M) preferably has an SP value within the range above, and it is preferably selected as appropriate in accordance with a material for the core resin (b) or a material for the precursor (b0) of the core resin (b). The organic solvent (M) is exemplified, for example, by an aromatic hydrocarbon based solvent such as toluene, xylene, ethylbenzene, and tetralin; an aliphatic or alicyclic hydrocarbon based solvent such as n-hexane, n-heptane, mineral spirit, and cyclohexane; a halogen based solvent such as methyl chloride, methyl bromide, methyl iodide, methylene dichloride, carbon tetrachloride, trichloroethylene, and perchlorethylene; an ester based or ester ether based solvent such as ethyl acetate, butyl acetate, methoxy butyl acetate, methyl Cello solve acetate, and ethyl Cellosolve acetate; an ether based solvent such as diethyl ether, THF, dioxane, ethyl Cellosolve, butyl Cellosolve, and propylene glycol monomethyl ether; a ketone based solvent such as acetone, methyl ethyl ketone, methyl isobutyl ketone, di-n-butyl ketone, and cyclohexanone; an alcohol based solvent such as methanol, ethanol, n-propanol, isopropanol, n-butanol, isobutanol, t-butanol, 2-ethylhexyl alcohol, and benzyl alcohol; an amide based solvent such as dimethylformamide and dimethylacetamide; a sulfoxide based solvent such as dimethyl sulfoxide; a heterocyclic compound based solvent such as N-methyl pyrrolidone; or a mixed solvent in which two or more of the solvents as being mixed.

From a point of view of odor or from a point of view of ease in distilling out, the organic solvent (M) has a boiling point preferably not higher than 100° C. and more preferably not higher than 90° C.

In a case where a polyester resin or a polyurethane resin is selected as the core resin (b), a preferred organic solvent (M) is exemplified, for example, by acetone, dimethylformamide, dimethyl sulfoxide, N-methyl pyrrolidone, and a mixed solvent in which two or more of these as being mixed.

From a point of view of particle size distribution of the toner particles (C), a solution (Y) for forming the core particles (B) has viscosity preferably not lower than 10 mPa·s and not higher than 50000 mPa·s and more preferably not lower than 100 mPa·s and not higher than 10000 mPa·s. Viscosity of the solution (Y) for forming the core particles (B) is preferably measured, for example, with a type B viscometer. The organic solvent (M) is preferably selected such that viscosity of the solution (Y) for forming the core particles (B) is within the range above.

The precursor (b0) of the core resin (b) is not particularly limited so long as it can become the core resin (b) through chemical reaction. For example, in a case where the core resin (b) is a vinyl resin, the precursor (b0) of the core resin (b) is exemplified, for example, by the monomers (1) to (9) having polymerizable double bond above (each may be used alone or two or more types may be used as being mixed).

In a case where the monomers (1) to (9) having polymerizable double bond above are employed as the precursor (b0) of the core resin (b), a method of making the core resin (b) through reaction of the precursor (b0) of the core resin (b) is exemplified, for example, by a method of dispersing and suspending an oil phase containing an oil-soluble initiator and a monomer in the organic solvent (M) and causing radical polymerization reaction of the obtained suspension through heating.

The oil-soluble initiator above is exemplified, for example, by an oil-soluble peroxide based polymerization initiator (I), an oil-soluble azo based polymerization initiator (II), and the like. A redox type polymerization initiator (III) obtained by using together a reducing agent in the oil-soluble peroxide based polymerization initiator (I) may be employed. Two or more of the oil-soluble peroxide based polymerization initiator (I), the oil-soluble azo based polymerization initiator (II), and the redox type polymerization initiator (III) may be used together.

The oil-soluble peroxide based polymerization initiator (I) is exemplified, for example, by acetyl peroxide, t-butylperoxy-2-ethylhexanoate, benzoyl peroxide, para-chlorobenzoyl peroxide, cumene peroxide, and the like.

The oil-soluble azo based polymerization initiator (II) is exemplified, for example, by 2,2'-azobisisobutyronitrile, 2,2'-azobis-2,4-dimethyl valeronitrile, dimethyl-2,2'-azobis (2-methyl propionate), 2,2'-azobis(4-methoxy-2,4-dimethyl valeronitrile), and the like.

A nonaqueous type redox type polymerization initiator (III) is exemplified, for example, by those obtained by using an oil-soluble reducing agent such as tertiary amine, naphthenate, mercaptans, or an organic metal compound (such as triethylaluminum, triethylboron, or diethyl zinc) together with oil-soluble peroxide such as hydroperoxide, dialkyl peroxide, or diacyl peroxide.

In a case where the core resin (b) is a condensed type resin (such as a polyurethane resin, an epoxy resin, or a polyester resin), the precursor (b0) of the core resin (b) is exemplified by combination of a prepolymer (a) having a reactive group (hereinafter abbreviated as "prepolymer (α)") and a curing agent (β).

The "reactive group" which the prepolymer (α) has refers to a group which can react with the curing agent (β). In this case, a method of obtaining the core resin (b) by causing the precursor (b0) of the core resin (b) to react is exemplified by a method of dispersing the prepolymer (α) and the curing agent (β) in the insulating liquid (L), followed by heating, to thereby react the prepolymer (α) and the curing agent (β) with each other.

Combination of the reactive group which the prepolymer (α) has and the curing agent (β) is exemplified by [14] to [15] below.

[14]: A reactive group which the prepolymer (α) has is a functional group (α1) which can react with an active hydrogen compound and the curing agent (β) is an active hydrogen group containing compound (β1).

[15]: A reactive group which the prepolymer (α) has is an active hydrogen containing group (α2) and the curing agent (β) is a compound (β2) which can react with an active hydrogen containing group.

In combination [14] above, the functional group (α1) which can react with an active hydrogen compound is exemplified, for example, by an isocyanate group (α1a), a blocked isocyanate group (α1b), an epoxy group (α1c), an acid anhydride group (α1d), an acid halide group (α1e), and the like. Among these, an isocyanate group (α1a), a blocked isocyanate group (α1b), and an epoxy group (alc) are preferred as the functional group (α1), and among these, an isocyanate group (α1a) and a blocked isocyanate group (α1b) are more preferred as a functional group (α1).

The blocked isocyanate group (α1b) refers to an isocyanate group blocked by a blocking agent. The blocking agent is exemplified, for example, by oximes (such as acetoxime, methylisobutylketoxime, diethylketoxime, cyclopentanone oxime, cyclohexanone oxime, or methylethylketoxime); lactams (such as γ-butyrolactam, ε-caprolactam, or γ-valerolactam); aliphatic alcohols having a carbon number from 1 to 20 (such as ethanol, methanol, or octanol); phenols (such as phenol, m-cresol, xylenol, or nonyl phenol); an active methylene compound (such as acetylacetone, ethyl malonate, or ethyl acetoacetate); a basic nitrogen containing compound (such as N,N-diethylhydroxyl amine, 2-hydroxypyridine, pyridine N-oxide, or 2-mercaptopyridine); or use thereof together. Among these, oximes are preferred as the blocked isocyanate group (α1b) and methylethylketoxime is more preferred.

A constitutional unit of the prepolymer (α) having a reactive group is exemplified, for example, by polyether (αw), polyester (αx), an epoxy resin (αy), polyurethane (αz), and the like. Among these, polyester (αx), an epoxy resin (αy), and polyurethane (αz) are preferred as a constitutional unit of the prepolymer (α), and polyester (αx) and polyurethane (αz) are more preferred.

Polyether (αw) is exemplified, for example, by polyethylene oxide, polypropylene oxide, polybutylene oxide, polytetramethylene oxide, and the like.

Polyester (αx) is exemplified, for example, by a polycondensed product of diol (11) and dicarboxylic acid (13), polylactone (such as a ring-opening polymerization product of ε-caprolactone), and the like.

The epoxy resin (αy) is exemplified, for example, by an addition condensed product of bisphenols (such as bisphenol A, bisphenol F, or bisphenol S) and epichlorohydrin.

Polyurethane (αz) is exemplified, for example, by a polyadduct of diol (11) and polyisocyanate (15), a polyadduct of polyester (αx) and polyisocyanate (15), and the like.

A method of causing polyester (αx), an epoxy resin (αy), polyurethane (αz), and the like to contain a reactive group is exemplified by a method shown in [16] to [17] below.

[16]: One of two or more constituent components is excessively used so that a functional group of a constituent component remains at a terminal.

[17]: One of two or more constituent components is excessively used so that a functional group of a constituent component remains at a terminal (a prepolymer is obtained) and a remaining functional group and a functional group which can react with that functional group are caused to react with each other, or a remaining functional group and a compound containing a functional group which can react with that functional group are caused to react with each other.

With the method in [16] above, a hydroxyl group containing polyester prepolymer, a carboxyl group containing polyester prepolymer, an acid halide group containing polyester prepolymer, a hydroxyl group containing epoxy resin prepolymer, an epoxy group containing epoxy resin prepolymer, a hydroxyl group containing polyurethane prepolymer, an isocyanate group containing polyurethane prepolymer, and the like are obtained.

For example, in a case where a hydroxyl group containing polyester prepolymer is to be obtained, a ratio between a polyol component and a polycarboxylic acid component should only be set such that an equivalent ratio between a hydroxyl group [OH] and a carboxyl group [COOH]([OH]/

[COOH]) is set preferably to 2/1 to 1/1, more preferably to 1.5/1 to 1/1, and further preferably to 1.3/1 to 1.02/1. Even though a skeleton changes or even in a case of obtaining a prepolymer having an end group, the ratio between the constituent components is preferably the same as described above while only a constituent component changes.

With the method in [17] above, an isocyanate group containing prepolymer is obtained by causing polyisocyanate to react with the prepolymer obtained in the method [16] above, a blocked isocyanate group containing prepolymer is obtained by causing a blocking polyisocyanate to react therewith, an epoxy group containing prepolymer is obtained by causing polyepoxide to react therewith, and an acid anhydride group containing prepolymer is obtained by causing polyacid anhydride to react therewith.

For example, in a case where an isocyanate group containing polyester prepolymer is to be obtained by causing a hydroxyl group containing polyester prepolymer to react with polyisocyanate, a ratio of polyisocyanate to a hydroxyl group containing polyester prepolymer should only be set such that an equivalent ratio between an isocyanate group [NCO] and a hydroxyl group [OH] of the hydroxyl group containing polyester ([NCO]/[OH]) is set preferably to 5/1 to 1/1, more preferably to 4/1 to 1.2/1, and further preferably to 2.5/1 to 1.5/1. Even though a skeleton changes or even in a case of obtaining a prepolymer having an end group, a ratio between the constituent components is preferably the same as described above while only a constituent component changes.

The number of reactive groups contained in one molecule of the prepolymer (a) is preferably one or more, more preferably not smaller than 1.5 and not greater than 3 on average, and further preferably not smaller than 1.8 and not greater than 2.5 on average. When the number of reactive groups contained in one molecule of the prepolymer (α) is within the range above, a molecular weight of a cured product obtained through reaction with the curing agent (β) is greater.

Mn of the prepolymer (α) is preferably not smaller than 500 and not greater than 30000, more preferably not smaller than 1000 and not greater than 20000, and further preferably not smaller than 2000 and not greater than 10000.

Mw of the prepolymer (α) is preferably not smaller than 1000 and not greater than 50000, more preferably not smaller than 2000 and not greater than 40000, and further preferably not smaller than 4000 and not greater than 20000.

Viscosity of the prepolymer (α) at 100° C. is preferably 200 Pa·s or lower and more preferably 100 Pa·s or lower. By setting viscosity of the prepolymer (α) to 200 Pa·s or lower, the core particles (B) narrow in distribution width in particle size distribution are obtained.

The active hydrogen group containing compound (β1) in combination [14] above is exemplified, for example, by polyamine (β1a) which may be blocked by a detachable compound (hereinafter abbreviated as "polyamine (β1a)"); polyol (β1b); polymercaptan (β1c); water; or the like. Among these, polyamine (β1a) and water are preferred as the active hydrogen group containing compound (β1), and blocked polyamines and water are further preferred.

Polyamine (β1a) is exemplified, for example, by those the same as listed as specific examples of polyamine (15). Polyamine (β1a) is preferably 4,4'-diaminodiphenylmethane, xylylenediamine, isophoron diamine, ethylenediamine, diethylenetriamine, triethylenetetramine, a mixture thereof, or the like.

In a case where polyamine (β1a) is polyamine blocked by a detachable compound, polyamine is exemplified, for example, by a ketimine compound obtained from polyamines above and ketones having a carbon number from 3 to 8 (such as acetone, methyl ethyl ketone, or methyl isobutyl ketone); an aldimine compound obtained from an aldehyde compound having a carbon number from 2 to 8 (such as formaldehyde or acetaldehyde); an enamine compound; an oxazolidine compound; or the like.

Polyol (β1b) is exemplified, for example, by those the same as listed as specific examples of diol (10) and polyol (11). Among these, diol (10) alone and a mixture of diol (10) and a small amount of polyol (11) are preferred as polyol (β1b).

Polymercaptan (β1c) is exemplified, for example, by ethylenedithiol, 1,4-butanedithiol, 1,6-hexanedithiol, and the like.

As necessary, a reaction stop agent (βs) can be used together with the active hydrogen group containing compound (β1). By using the reaction stop agent (βs) at a certain ratio together with the active hydrogen group containing compound (β1), a molecular weight of the resin (b) can be adjusted to a prescribed value. For the same reason, the reaction stop agent (βs) can also be used together with a compound (β2) which can react with an active hydrogen containing group in combination [15] above.

The reaction stop agent (βs) is exemplified, for example, by monoamine (such as diethylamine, dibutylamine, butylamine, laurylamine, monoethanolamine, or diethanolamine); blocked monoamine (such as a ketimine compound); monool (such as methanol, ethanol, isopropanol, butanol, or phenol); monomercaptan (such as butyl mercaptan or lauryl mercaptan); monoisocyanate (such as lauryl isocyanate or phenyl isocyanate); monoepoxide (such as butyl glycidyl ether); or the like.

The active hydrogen containing group (α2) which the prepolymer (α) has in combination [15] above is exemplified, for example, by an amino group (α2a), a hydroxyl group (such as an alcoholic hydroxyl group or a phenolic hydroxyl group) (α2b), a mercapto group (α2c), a carboxyl group (α2d), an organic group (α2e) in which the former are blocked by a detachable compound, and the like. Among these, an amino group (α2a), a hydroxyl group (α2b), and an organic group (α2e) are preferred, and a hydroxyl group (α2b) is more preferred.

The organic group (α2e) of which amino group is blocked by a detachable compound is exemplified by those the same as listed as specific examples of polyamine (β1a).

The compound (β2) which can react with the active hydrogen containing group in combination [15] is exemplified, for example, by polyisocyanate (β2a), polyepoxide (β2b), polycarboxylic acid (β2c), polyacid anhydride (β2d), polyacid halide (β2e), and the like. Among these, polyisocyanate (β2a) and polyepoxide (β2b) are preferred as the compound (β2), and polyisocyanate (β2a) is more preferred.

Polyisocyanate (β2a) is exemplified, for example, by those the same as listed as specific examples of polyisocyanate (14). What is preferred as polyisocyanate (β2a) is also the same as those listed as preferred specific examples of polyisocyanate (14).

Polyepoxide (β2b) is exemplified, for example, by those the same as listed as specific examples of polyepoxide (18). What is preferred as polyepoxide (β2b) is also the same as those listed as preferred specific examples of polyepoxide (18).

Polycarboxylic acid (β2c) is exemplified, for example, by dicarboxylic acid (β2c-1), polycarboxylic acid (β2c-2) equal to or higher than trivalence, and the like. Among these, dicarboxylic acid (β2c-1) alone and a mixture of dicarboxylic acid (β2c-1) and a small amount of polycarboxylic acid (β2c-2) are preferred as polycarboxylic acid (β2c).

Dicarboxylic acid (β2c-1) is exemplified, for example, by those the same as listed as specific examples of dicarboxylic acid (12) and polycarboxylic acid (13). What is preferred as dicarboxylic acid (β2c-1) is also the same as those listed as preferred specific examples of dicarboxylic acid (12) and polycarboxylic acid (13).

The polycarboxylic anhydride (β2d) is exemplified, for example, by pyromellitic anhydride.

The polyacid halides (β2e) are exemplified, for example, by acid halide of polycarboxylic acid (β2c) (such as acid chloride, acid bromide, or acid iodide).

A ratio of the curing agent (β) in the precursor (b0) of the core resin (b) is not particularly limited. A ratio of the curing agent (β) in the precursor (b0) of the core resin (b) should only be set such that an equivalent ratio between the reactive group [α] in the prepolymer (α) and the active hydrogen containing group [β] in the curing agent (β) ([α]/[β]) is preferably from 1/2 to 2/1, more preferably from 1.5/1 to 1/1.5, and further preferably from 1.2/1 to 1/1.2. In a case where water is employed as the curing agent (β), water is handled as a divalent active hydrogen compound.

<Step [III]>

In the step [III], by dispersing the solution for forming the core particles (B) in the dispersion liquid (W) of the shell particles (A), the core particles (B) containing the core resin (b) are formed in the insulating liquid (L) and the toner particles (C) having the core-shell structure that the shell particles (A) are attached to or cover the surfaces of the core particles (B) are formed.

Though a method of dispersing the solution for forming the core particles (B) in the dispersion liquid (W) of the shell particles (A) is not particularly limited, the solution for forming the core particles (B) is preferably dispersed in the dispersion liquid (W) of the shell particles (A) with the use of a dispersion apparatus.

The dispersion apparatus is not particularly limited so long as it is generally commercially available as an emulsifier, a disperser, or the like. A dispersion apparatus is exemplified, for example, by a batch type emulsifier such as Homogenizer (manufactured by IKA), Polytron (a trade name, manufactured by Kinematica AG) and T.K. Auto Homo Mixer (a trade name, manufactured by Tokushu Kika Kogyo Co., Ltd.); a continuous emulsifier such as Ebara Milder (a trade name, manufactured by Ebara Corporation), T.K. Filmix and T.K. Pipeline Homo Mixer (both of which are trade names, manufactured by Tokushu Kika Kogyo Co., Ltd.), Colloid Mill (manufactured by Shinco Pantec Co., Ltd.), Slasher and Trigonal Wet Pulverizer (manufactured by Mitsui Miike Chemical Engineering Machinery Co., Ltd.), Cavitron (manufactured by Eurotec Co., Ltd.), and Fine Flow Mill (manufactured by Pacific Machinery & Engineering Co., Ltd.); a high-pressure emulsifier such as Microfluidizer (a trade name, manufactured by Mizuho Industrial Co., Ltd.), Nanomizer (a trade name, manufactured by Nanomizer Inc.), and APV Gaulin (a trade name, manufactured by Gaulin); a membrane emulsifier such as Membrane Emulsifier (manufactured by Reica Co., Ltd.); a vibration emulsifier such as Vibro Mixer (manufactured by Reica Co., Ltd.); an ultrasonic emulsifier such as Ultrasonic Homogenizer (manufactured by Branson); and the like. Among these apparatuses, from a point of view of particle size distribution of toner particles, APV Gaulin, Homogenizer, T.K. Auto Homo Mixer, Ebara Milder, T.K. Filmix, and T.K. Pipeline Homo Mixer are preferred.

Though a temperature at the time when the solution for forming the core particles (B) is dispersed in the dispersion liquid (W) of the shell particles (A) is not particularly limited, it is preferably not lower than 0° C. and not higher than 150° C. (under pressure) and more preferably not lower than 5° C. and not higher than 98° C. When viscosity of a solution obtained by dispersing the solution for forming the core particles (B) in the dispersion liquid (W) of the shell particles (A) (hereinafter also denoted as a dispersion liquid (X') of the resin particles) is high, viscosity of the solution for forming the core particles (B) is preferably lowered to a preferred range by raising a temperature at the time when the solution (Y) for forming the core particles (B) is dispersed in the dispersion liquid (W) of the shell particles (A). The preferred range of viscosity of the solution for forming the core particles (B) is as explained in the description of the step [II] above, and it is not lower than 10 mPa·s and not higher than 50000 mPa·s (viscosity measured with a type B viscometer).

A ratio of mixing between the dispersion liquid (W) of the shell particles (A) and the solution for forming the core particles (B) is not particularly limited, however, the dispersion liquid (W) of the shell particles (A) preferably not smaller than 50 parts by mass and not greater than 2000 parts by mass and more preferably not smaller than 100 parts by mass and not greater than 1000 parts by mass with respect to 100 parts by mass of the core resin (b) or the precursor (b0) of the core resin (b) dissolved in the solution (Y) for forming the core particles (B) is contained. If at least 50 parts by mass of the dispersion liquid (W) of the shell particles (A) are contained with respect to 100 parts by mass of the core resin (b) or the precursor (b0) of the core resin (b), a state of dispersion of the core resin (b) or the precursor (b0) of the core resin (b) in the dispersion liquid (X') of the resin particles is good. When at most 2000 parts by mass of the dispersion liquid (W) of the shell particles (A) are contained with respect to 100 parts by mass of the core resin (b) or the precursor (b0) of the core resin (b), it is inexpensive.

Though the core-shell structure is formed by dispersing the solution for forming the core particles (B) in the dispersion liquid (W) of the shell particles (A), force of adsorption of the shell particles (A) to the core particles (B) is preferably controlled in accordance with methods shown in [18] to [20] below.

[18]: The shell particles (A) and the core particles (B) have charges opposite to each other in polarity. Here, as charges of the shell particles (A) and the core particles (B) are greater, force of adsorption of the shell particles (A) to the core particles (B) is stronger and hence a ratio of coverage of the surfaces of the core particles (B) with the shell particles (A) is higher.

[19]: The shell particles (A) and the core particles (B) have charges of the same polarity, so that a ratio of coverage of the surfaces of the core particles (B) with the shell particles (A) is lower. Here, when at least one of the surfactant (s) above and the oil-based polymer (t) above (in particular, which will make polarity opposite between the shell particles (A) and the core particles (B)) is used, force of adsorption of the shell particles (A) to the core particles (B) is stronger and hence a ratio of coverage of the surfaces of the core particles (B) with the shell particles (A) is higher.

[20]: A difference in SP value between the dispersion liquid (W) of the shell particles (A) and the solution (Y) for forming the core particles (B) is made smaller, so that force of adsorption of the shell particles (A) to the core particles (B) is stronger and hence a ratio of coverage of the surfaces of the core particles (B) with the shell particles (A) is higher.

Whether the core-shell structure that the shell particles (A) are attached to the surfaces of the core particles (B) or the core-shell structure that the shell particles (A) cover the surfaces of the core particles (B) is formed is dependent on physical properties of the organic solvent (M) contained in the solution (Y) for forming the core particles (B), specifically, solubility of the shell particles (A) and/or the core resin (b) in the organic solvent (M).

Specifically, when a solvent which dissolves the core resin (b) but does not dissolve the shell particles (A) is selected as the organic solvent (M), the shell particles (A) are attached to the surfaces of the core particles (B).

On the other hand, when a solvent dissolving both of the shell particles (A) and the core resin (b) is selected as the organic solvent (M), the shell particles (A) are attached to the surfaces of the core particles (B) while they are molten in the organic solvent (M). Therefore, as the organic solvent (M) is distilled out in a subsequent step, the organic solvent (M) attached to the surfaces of the core particles (B) is also distilled out. Therefore, the shell particles (A) are formed like a film on the surfaces of the core particles (B). Formation of the shell particles (A) on the surfaces of the core particles (B) like a film will be denoted as "film formation treatment" below.

For film formation treatment, as the organic solvent (M), THF, toluene, acetone, methyl ethyl ketone, ethyl acetate, or the like is preferably selected, and acetone, ethyl acetate, or the like is more preferably selected.

In performing film formation treatment, a content of the organic solvent (M) in the dispersion liquid (X') of the resin particles is preferably not lower than 10 mass % and not higher than 50 mass % and more preferably not lower than 20 mass % and not higher than 40 mass %. In distilling out the organic solvent (M) after the film formation treatment, the organic solvent (M) should only be removed until a content of the organic solvent (M) in the dispersion liquid (X') of the resin particles at a temperature not higher than 40° C. is preferably not higher than 1 mass % and more preferably not higher than 0.5 mass %. Thus, a shell layer formed of the shell particles (A) which have been dissolved in the organic solvent (M) is formed on the surface of the core layer formed of the core particles (B).

In performing film formation treatment, an organic solvent to be used in the film formation treatment can be added to the dispersion liquid (X') of the resin particles. The organic solvent (M) contained in the solution (Y) for forming the core particles (B), however, is preferably used as an organic solvent for film formation treatment without removing the organic solvent after formation of the core particles (B). This is because the organic solvent (M) is contained in the core particles (B) and hence the shell particles (A) can readily be dissolved in the organic solvent (M) and aggregation of the core particles (B) is less likely.

In dissolving the shell particles (A) in the organic solvent (M), a concentration of the organic solvent (M) in the dispersion liquid (X) of the resin particles is preferably not lower than 3 mass % and not higher than 50 mass %, more preferably not lower than 10 mass % and not higher than 40 mass %, and further preferably not lower than 15 mass % and not higher than 30 mass %. The dispersion liquid (X') of the resin particles is preferably stirred, for example, for a period not shorter than 1 hour and not longer than 10 hours. A temperature at the time when the shell particles (A) are dissolved in the organic solvent (M) is preferably not lower than 15° C. and not higher than 45° C. and more preferably not lower than 15° C. and not higher than 30° C.

When the shell particles (A) are dissolved in the organic solvent (M) to form a film on the surfaces of the core particles (B), a solid content in the dispersion liquid (X') of the resin particles (a content of a component other than a solvent) is preferably not lower than 1 mass % and not higher than 50 mass % and more preferably not lower than 5 mass % and not higher than 30 mass %. A content of the organic solvent (M) at the time when the toner particles (C) are formed is preferably not higher than 2 mass %, more preferably not higher than 1 mass %, and further preferably not higher than 0.5 mass %. In a case where a solid content in the dispersion liquid (X') of the resin particles is high and in a case where a content of the organic solvent (M) at the time when the toner particles (C) are formed exceeds 2 mass %, an aggregate may be generated when a temperature of the dispersion liquid (X') of the resin particles is raised to 60° C. or higher. A method of melting the shell particles (A) is not particularly limited, and for example, a method of heating for a period preferably not shorter than 1 minute and not longer than 300 minutes preferably at a temperature not lower than 40° C. and not higher than 100° C., more preferably not lower than 60° C. and not higher than 90° C., and further preferably not lower than 60° C. and not higher than 80° C. while stirring is exemplified.

In performing film formation treatment, the dispersion liquid (X') of the resin particles of which content of the organic solvent (M) at the time when the toner particles (C) are formed is not higher than 2 mass % is preferably heated, so that the shell particles (A) are molten on the surfaces of the core particles (B). Thus, toner particles (C) of which surfaces are smoother can be obtained. A heating temperature at this time is preferably not lower than Tg of the shell resin (a) and more preferably not higher than 80° C. If a heating temperature is lower than Tg of the shell resin, an effect obtained by heating (that is, an effect that the surfaces of the toner particles are smoother) may not be obtained. On the other hand, when a heating temperature exceeds 80° C., a shell layer may peel off from a core layer.

A method preferred as film formation treatment is a method of melting the shell particles (A) and combination of the method of dissolving the shell particles (A) and the method of melting the shell particles (A).

By fabricating a liquid mixture by adding a solution of the shell resin (a) into the solution for forming the core particles (B) adjusted in advance in the step [II] and dispersing the liquid mixture in the insulating liquid (L) instead of dispersing the solution for forming the core particles (B) in the dispersion liquid (W) in the step [III] after fabricating the shell resin (a), instead of fabricating the dispersion liquid (W) through the step [I], the core particles (B) containing the core resin (b) can be formed, and by moving the shell resin (a) to the surface of the core particles (B), the toner particles (C) having the core-shell structure that the shell particles (A) are attached to or cover the surfaces of the core particles (B) can be obtained. In this case, composition of the shell resin (a) is desirably designed such that the shell resin (a) is smaller in SP value than the core resin (b) or the shell resin has a skeleton having a small SP value comparable to that of the insulating liquid (L).

<Step [IV]>

In the step [IV], the organic solvent (M) contained in the solution for forming the core particles (B) is distilled out of the dispersion liquid (X') of the resin particles.

Though a method of distilling out the organic solvent (M) from the dispersion liquid (X') of the resin particles is not particularly limited, for example, a method of distilling out the organic solvent (M) at a reduced pressure not lower than 0.02 MPa and not higher than 0.066 MPa at a temperature not lower than 20° C. and not higher than a boiling point of the organic solvent (M) is exemplified.

A content of the organic solvent (M) in the dispersion liquid from which the organic solvent (M) has been distilled out is preferably not higher than 1 mass % and more preferably not higher than 0.5 mass %. Some of the insulating liquid (L) (for example, a low boiling point component of the insulating liquid (L)) may also be distilled out together with the organic solvent (M).

By controlling at least one of a difference in SP value between the shell resin (a) and the core resin (b) and a molecular weight of the core resin (a), a shape of the toner particles (C) contained in the liquid developer (X) thus obtained and smoothness of the surfaces of the toner particles (C) are controlled. When a difference in SP value is too small, toner particles having an irregular shape but having a smooth surface tend to be obtained. In contrast, when a difference in SP value is too large, toner particles having a spherical shape but having a grainy surface tend to be obtained. When a molecular weight of the shell resin (a) is too large, toner particles having a grainy surface tend to be obtained, and when a molecular weight of the shell resin (a) is too small, toner particles having a smooth surface tend to be obtained. When a difference in SP value is too small or too large, granulation becomes difficult. When a molecular weight of the shell resin (a) is too small, granulation again becomes difficult. From the foregoing, the difference in SP value is preferably not smaller than 0.01 and not greater than 5.0, more preferably not smaller than 0.1 and not greater than 3.0, and further preferably not smaller than 0.2 and not greater than 2.0 Mw of the shell resin (a) is preferably not smaller than 100 and not greater than 1000000, more preferably not smaller than 1000 and not greater than 500000, further preferably not smaller than 2000 and not greater than 200000, and most preferably not smaller than 3000 and not greater than 100000.

In manufacturing the core-shell structure in the present embodiment, the shell particles (A) may be attached to or cover the surfaces of the core particles (B) after the core particles (B) are manufactured in accordance with the manufacturing method in any of [7] to [13] above.

In the method for manufacturing the liquid developer (X) according to the present embodiment, an additive other than a coloring agent (such as a wax, a filler, an antistatic agent, a release agent, a charge control agent, a UV absorber, an antioxidant, an antiblocking agent, a heat-resistant stabilization agent, and a fire retardant) may be added to prepare at least one of the dispersion liquid (W) of the shell particles (A), the solution (Y) for forming the core particles (B), and the dispersion liquid of the coloring agent. In this case as well, by adding a solution in which an additive other than a coloring agent has been dissolved or dispersed to the dispersion liquid (W) of the shell particles (A) or the like, the additive can be added to the dispersion liquid (W) of the shell particles (A) or the like. Thus, the toner particles (C) in which an additive other than a coloring agent is also contained in at least one layer of the core layer and the shell layer can be obtained.

<Step [V]>

The core particles (B) in the present embodiment preferably contain the core resin (b) and a coloring agent. The coloring agent may be dispersed in at least one of the dispersion liquid (W) of the shell particles (A) and the solution for forming the core particles (B), or the coloring agent may be dispersed in a prescribed organic solvent and then mixed in at least one of the dispersion liquid (W) of the shell particles (A) and the solution for forming the core particles (B).

At least one of pigments listed in the description of the coloring agents can be employed as the coloring agent. For example, such an organic solvent as acetone can be employed as a solution in which the coloring agent is to be dissolved or dispersed.

EXAMPLES

Though the present invention will be described in further detail with reference to Examples, the present invention is not limited thereto.

Manufacturing Example 1

[Manufacturing of Dispersion Liquid (W) of Shell Particles (A)]

In Manufacturing Examples and Examples below, a type of the shell particles (A) is denoted, for example, as shell particles (A1), shell particles (A2), and so on. A dispersion liquid in which the shell particles (A1) are dispersed is denoted, for example, as a dispersion liquid (W1) and so on.

Manufacturing Example 1-1

[Manufacturing of Dispersion Liquid (W1) of Shell Particles (A1)]

In a reaction vessel provided with a stirrer, a heating and cooling apparatus, a thermometer, a dropping funnel, a desolventizer, and a nitrogen introduction pipe, 195 parts by mass of THF were introduced. In a beaker made of glass, a liquid mixture composed of 100 parts by mass of 2-decyltetradecyl acrylate, 30 parts by mass of methacrylic acid, 70 parts by mass of an equimolar reactant with hydroxyethyl methacrylate and phenyl isocyanate, and 0.5 part by mass of azobis methoxy dimethyl valeronitrile was introduced, and stirred and mixed at 20° C. Thus, a monomer solution was adjusted and introduced in the dropping funnel. After a vapor phase portion of the reaction vessel was replaced with nitrogen, the monomer solution was dropped for 1 hour at 70° C. in a sealed condition. Three hours after the end of dropping, a mixture of 0.05 part by mass of azobis methoxy dimethyl valeronitrile and 5 parts by mass of THF was added and caused to react for 3 hours at 70° C. Thereafter, cooling to room temperature was carried out. Thus, a solution of a copolymer including the shell particles (A1) was obtained. While 400 parts by mass of the solution including the copolymer including the shell particles (A1) were stirred, the solution was dropped in 600 parts by mass of Isopar L (manufactured by ExxonMobil), and THF was distilled out at 40° C. at a reduced pressure of 0.039 MPa. Thus, the dispersion liquid (W1) of the shell particles (A1) was obtained. A volume average particle size of the shell particles (A1) contained in the dispersion liquid (W1), which was measured with "LA-920", was 0.12 μm.

Manufacturing Example 1-2

[Manufacturing of Polyester Resin]

In a reaction vessel provided with a stirrer, a heating and cooling apparatus, a thermometer, a cooling pipe, and a nitrogen introduction pipe, 286 parts by mass of dodecanedioic acid, 190 parts by mass of 1,6-hexanediol, and 1 part by mass of titanium dihydroxybis(triethanolaminate) as a condensation catalyst were introduced. These were caused to react for 8 hours under a nitrogen current at 180° C. while generated water was distilled out. While a temperature was gradually raised to 220° C. and generated water was distilled out, they were further caused to react for 4 hours under a nitrogen current. They were caused to react for 1 hour at a reduced pressure not lower than 0.007 MPa and not higher than 0.026 MPa. Thus, a polyester resin was obtained. The obtained polyester resin had a melting point of 68° C., Mn of 4900, and Mw of 10000.

[Manufacturing of Dispersion Liquid (W2) of Shell Particles (A2)]

In a reaction vessel provided with a stirrer, a heating and cooling apparatus, a thermometer, a dropping funnel, a desolventizer, and a nitrogen introduction pipe, 195 parts by mass of THF were introduced. In a beaker made of glass, a liquid mixture composed of 80 parts by mass of 2-decyltetradecyl acrylate, 10 parts by mass of methyl methacrylate, 10 parts by mass of methacrylic acid, 10 parts by mass of an equimolar reactant with an isocyanate group containing monomer (a trade name: Karenz MOI manufactured by Showa Denko K.K.) and the polyester resin obtained above, and 0.5 part by mass of azobis methoxy dimethyl valeronitrile was introduced, and stirred and mixed at 20° C. Thus, a monomer solution was adjusted and introduced in the dropping funnel. After a vapor phase portion of the reaction vessel was replaced with nitrogen, the monomer solution was dropped for 1 hour at 70° C. in a sealed condition. Three hours after the end of dropping, a mixture of 0.05 part by mass of azobis methoxy dimethyl valeronitrile and 5 parts by mass of THE was added and caused to react for 3 hours at 70° C. Thereafter, cooling to room temperature was carried out. Thus, a solution of a copolymer including the shell particles (A2) was obtained. While 400 parts by mass of the solution including the copolymer including the shell particles (A2) were stirred, the solution was dropped in 600 parts by mass of Isopar L (manufactured by ExxonMobil), and THF was distilled out at 40° C. at a reduced pressure of 0.039 MPa. Thus, a dispersion liquid (W2) of shell particles (A2) was obtained. A volume average particle size of the shell particles (A2) contained in the dispersion liquid (W2), which was measured with "LA-920", was 0.13 μm.

Manufacturing Example 2

[Manufacturing of Solution for Forming Core Particles (B) of Core Resin (b)]

In Manufacturing Examples and Examples below, a type of the core resin (b) is denoted, for example, as a core resin (b1), a core resin (b2), and so on. Core particles containing the core resin (b1) are denoted, for example, as core particles (B1) and so on. A solution for forming the core particles (B) in which the core resin (b1) or a precursor thereof has been dissolved is denoted, for example, as a solution for forming the core particles (B1) and so on.

Manufacturing Example 2-1

[Manufacturing of Solution for Forming Core Particles (B1) of Core Resin (b1)]

In a reaction vessel provided with a stirrer, a heating and cooling apparatus, a thermometer, and a nitrogen introduction pipe, 746 parts by mass (6.3 parts by mole) of ethylene glycol, 288 parts by mass (1.7 part by mole) of sebacic acid, and 3 parts by mass of tetrabutoxytitanate as a condensation catalyst were introduced. After polycondensation for 6 hours at 230° C. at a normal atmospheric pressure, a pressure in a system was reduced and the pressure was set again to the normal atmospheric pressure at the time point when an acid value attained to 1.0, and a temperature was lowered to 180° C. At 180° C., 28 parts by mass (0.1 part by mole) of phthalic anhydride were introduced and caused to react for 1 hour at that temperature, to thereby obtained the core resin (b1) representing a polyester resin. The core resin (b1) thus obtained had a carboxyl group representing an acid group at a terminal, and the core resin had pKa of 2.94, Tg of 72° C., Mn of 2400, a hydroxyl value of 40, and an acid value of 15. Then, 1000 parts by mass of the core resin (b1) and 1000 parts by mass of acetone were introduced in a beaker and stirred so that they were uniformly dissolved. A solution for forming the core particles (B1) was thus obtained.

Manufacturing Example 2-2

[Manufacturing of Solution for Forming Core Particles (B2) of Core Resin (b2)]

In a reaction vessel provided with a stirrer, a heating and cooling apparatus, a thermometer, a desolventizer, and a nitrogen introduction pipe, 701 parts by mass (18.8 parts by mole) of 1,2-propylene glycol (hereinafter also denoted as PG), 716 parts by mass (7.5 parts by mole) of terephthalic acid dimethyl ester, 180 parts by mass (2.5 parts by mole) of adipic acid, and 3 parts by mass of tetrabutoxytitanate as a condensation catalyst were introduced. After reaction for 8 hours at 180° C. while methanol was distilled out under a nitrogen current, reaction was caused while PG and water were distilled out under a nitrogen current with gradual increase in temperature to 230° C. Further reaction under a reduced pressure not lower than 0.007 MPa and not higher than 0.026 MPa was caused, and the substance was taken out at a time point when a softening point attained to 150° C., to thereby obtain a core resin (b2) representing a polyester resin. Here, 316 parts by mass (8.5 parts by mole) of PG were collected. The core resin (b2) thus obtained did not have an acid group at a terminal, and had Tg of 64° C., Mn of 8800, a hydroxyl value of 13, and an acid value of 0.2. Then, 1000 parts by mass of the core resin (b2) and 1000 parts by mass of acetone were introduced in a beaker and stirred so that they were uniformly dissolved. A solution for forming the core particles (B2) was thus obtained.

Manufacturing Example 2-3

[Manufacturing of Solution for Forming Core Particles (B3) of Core Resin (b3)]

In a reaction vessel provided with a stirrer, a heating and cooling apparatus, a thermometer, and a nitrogen introduction pipe, 746 parts by mass (6.3 parts by mole) of ethylene glycol, 288 parts by mass (1.7 part by mole) of sebacic acid, and 3 parts by mass of tetrabutoxytitanate as a condensation catalyst were introduced. After polycondensation for 6 hours at 230° C. at a normal atmospheric pressure, a pressure in a system was reduced and the pressure was set again to the normal atmospheric pressure at the time point when an acid value attained to 1.0, and a temperature was lowered to 180° C. At 180° C., 28 parts by mass (0.1 part by mole) of trimellitic anhydride were introduced and caused to react for 1 hour at that temperature, to thereby obtained a core resin (b3) representing a polyester resin. The core resin (b3) thus obtained had a carboxyl group representing an acid group at a terminal, and the core resin had pKa of 2.52, Tg of 72° C., Mn of 2400, a hydroxyl value of 40, and an acid value of 15. Then, 1000 parts by mass of the core resin (b3) and 1000 parts by mass of acetone were introduced in a beaker and stirred so that they were uniformly dissolved. A solution for forming the core particles (B3) was thus obtained.

Manufacturing Example 2-4

[Manufacturing of Solution for Forming Core Particles (B4) of Core Resin (b4)]

In a reaction vessel provided with a stirrer, a heating and cooling apparatus, a thermometer, and a nitrogen introduction pipe, 746 parts by mass (2.1 parts by mole) of 2-mole adduct of PO to bisphenol A, 288 parts by mass (1.7 part by mole) of terephthalic acid, and 3 parts by mass of tetrabutoxytitanate as a condensation catalyst were introduced. After polycondensation for 6 hours at 230° C. at a normal atmospheric pressure, a pressure in a system was reduced and the pressure was set again to the normal atmospheric pressure at the time point when an acid value attained to 1.0, and a temperature was lowered to 180° C. At 180° C., 28 parts by mass (0.1 part by mole) of trimellitic anhydride were introduced and caused to react for 1 hour at that temperature, to thereby obtained a core resin (b4) representing a polyester resin. The core resin (b4) thus obtained had a carboxyl group representing an acid group at a terminal, and the core resin had pKa of 2.52, Tg of 72° C., Mn of 2400, a hydroxyl value of 40, and an acid value of 15. Then, 1000 parts by mass of the core resin (b4) and 1000 parts by mass of acetone were introduced in a beaker and stirred so that they were uniformly dissolved. A solution for forming the core particles (B4) was thus obtained.

Manufacturing Example 2-5

[Manufacturing of Solution for Forming Core Particles (B5) of Core Resin (b5)]

In a reaction vessel provided with a stirrer, a heating and cooling apparatus, a thermometer, and a nitrogen introduction pipe, 746 parts by mass (2.1 parts by mole) of 2-mole adduct of PO to bisphenol A, 288 parts by mass (1.7 part by mole) of terephthalic acid, and 3 parts by mass of tetrabutoxytitanate as a condensation catalyst were introduced. After polycondensation for 6 hours at 230° C. at a normal atmospheric pressure, a pressure in a system was reduced and the pressure was set again to the normal atmospheric pressure at the time point when an acid value attained to 1.0, and a temperature was lowered to 180° C. At 180° C., 60 parts by mass (0.1 part by mole) of methylhexahydrophthalic anhydride were introduced and caused to react for 1 hour at that temperature, to thereby obtained a core resin (b5) representing a polyester resin. The core resin (b5) thus obtained had a carboxyl group representing an acid group at a terminal, and the core resin had pKa of 5.61, Tg of 72° C., Mn of 2400, a hydroxyl value of 51, and an acid value of 31. Then, 1000 parts by mass of the core resin (b5) and 1000 parts by mass of acetone were introduced in a beaker and stirred so that they were uniformly dissolved. A solution for forming the core particles (B5) was thus obtained.

Manufacturing Example 2-6

[Manufacturing of Solution for Forming Core Particles (B6) of Core Resin (b6)]

In a reaction vessel provided with a stirrer, a heating and cooling apparatus, a thermometer, and a nitrogen introduction pipe, 746 parts by mass (6.3 parts by mole) of ethylene glycol, 288 parts by mass (1.7 part by mole) of sebacic acid, and 3 parts by mass of tetrabutoxytitanate as a condensation catalyst were introduced. After polycondensation for 6 hours at 230° C. at a normal atmospheric pressure, a pressure in a system was reduced and the pressure was set again to the normal atmospheric pressure at the time point when an acid value attained to 1.0, and a temperature was lowered to 180° C. At 180° C., 28 parts by mass (0.1 part by mole) of catechol were introduced and caused to react for 1 hour at that temperature, to thereby obtained a core resin (b6) representing a polyester resin. The core resin (b6) thus obtained had a carboxyl group representing an acid group at a terminal, and the core resin had pKa of 9.50, Tg of 72° C., Mn of 2,400, a hydroxyl value of 40, and an acid value of 8. Then, 1000 parts by mass of the core resin (b6) and 1000 parts by mass of acetone were introduced in a beaker and stirred so that they were uniformly dissolved. A solution for forming the core particles (B6) was thus obtained.

Manufacturing Example 3

[Manufacturing of Urethane Prepolymer]

In a reaction vessel provided with a stirrer, a heating and cooling apparatus, a dehydrator, and a thermometer, 2000 parts by mass of polycaprolactone diol (a trade name: "Placcel L220AL" manufactured by Daicel Chemical Industries, Ltd.) having a hydroxyl value of 56 were introduced and heated to 110° C., and dehydrated for 1 hour at a reduced pressure of 0.026 MPa. Then, 457 parts by mass of IPDI were introduced and caused to react for 10 hours at 110° C. Thus, a urethane prepolymer having an isocyanate group at a terminal was obtained. An NCO content of the urethane prepolymer was 3.6 mass %.

Manufacturing Example 4

[Manufacturing of Curing Agent]

In a reaction vessel provided with a stirrer, a heating and cooling apparatus, and a thermometer, 50 parts by mass of ethylene diamine and 300 parts by mass of methyl isobutyl ketone were introduced and caused to react for 5 hours at 50° C. Thus, a curing agent composed of a ketimine compound was obtained.

Manufacturing Example 5

[Manufacturing of Dispersion Liquid of Coloring Agent]

In a beaker, 25 parts by mass of copper phthalocyanine, 4 parts by mass of a dispersant for a coloring agent (a trade name: "Ajisper PB-821" manufactured by Ajinomoto Fine-Techno Co., Inc.), and 75 parts by mass of acetone were introduced and stirred, for uniform dispersion. Thereafter, copper phthalocyanine was finely dispersed with the use of a bead mill. Thus, a dispersion liquid of a coloring agent was obtained. A volume average particle size of the coloring agent contained in the dispersion liquid of the coloring agent was 0.2 μm.

Manufacturing Example 6

[Manufacturing of Solution for Forming Core Particles (B7) of Core Resin (b7)]

In a reaction vessel provided with a stirrer, a heating and cooling apparatus, and a thermometer, 937 parts by mass of polyester (Mn: 5000) obtained from sebacic acid, adipic acid, and ethylene glycol (a molar ratio of 0.8:0.2:1) and 300 parts by mass of acetone were introduced and stirred, for uniform solution. In this solution, 63 parts by mass of isophoron diisocyanate (IPDI) were introduced and caused to react for 6 hours at 80° C. When an NCO value attained to 0, 28 parts by mass (0.1 part by mole) of trimellitic anhydride were introduced and caused to react for 1 hour at 180° C. Thus, a core resin (b7) which was a urethane resin was obtained. The core resin (b7) had Mn of 25000 and a concentration of a urethane group of 2.00. The core resin (b7) thus obtained had a carboxyl group representing an acid group at a terminal, and had pKa of 6.20. Then, 1300 parts by mass of the core resin (b7) and 700 parts by mass of acetone were introduced and stirred in a beaker, for uniform solution. Thus, a solution for forming the core particles (B7) was obtained. A "concentration of a urethane group (mass %)" means a value obtained by multiplying a value, which was obtained by dividing a mass of a urethane group contained in a resin by a mass of the resin, by 100.

In the description of Examples below, for example, a liquid developer according to Example 1 is denoted as a liquid developer (X-1), a liquid developer according to Example 2 is denoted as a liquid developer (X-2), and so on. Similarly, in Comparative Examples, for example, a liquid developer according to Comparative Example 1 is denoted as a liquid developer (Z-1) and so on.

Example 1

Forty five parts by mass of the solution for forming the core particles (B1) obtained in Manufacturing Example 2-1 and 15 parts by mass of the dispersion liquid of the coloring agent obtained in Manufacturing Example 4 were introduced in a beaker and stirred at 8000 rpm with the use of T.K. Auto Homo Mixer (a trade name, manufactured by Tokushu Kika Kogyo Co., Ltd.) at 25° C. for uniform dispersion. Thus, a mixture solution of the solution for forming the core particles (B1) and the dispersion liquid of the coloring agent was obtained.

In another beaker, 67 parts by mass of liquid paraffin and 6 parts by mass of the dispersion liquid (W1) obtained in Manufacturing Example 1-1 were introduced for uniform dispersion. Then, while T.K. Auto Homo Mixer was used at 25° C. to perform stirring at 10000 rpm, 60 parts by mass of the mixture solution of the solution for forming the core particles (B1) and the dispersion liquid of the coloring agent were introduced and stirred for 2 minutes. Then, this liquid mixture was introduced in a reaction vessel provided with a stirrer, a heating and cooling apparatus, a thermometer, and a desolventizer, and a temperature was raised to 35° C. Thereafter, at a reduced pressure of 0.039 MPa at 35° C., acetone was distilled out until a concentration of acetone was not higher than 0.5 mass %. Thus, a liquid developer (X-1) was obtained. A concentration of acetone in the liquid developer (X-1) was quantified with the use of gas chromatography (a trade name: "GC2010" manufactured by Shimadzu Corporation) of a flame ionization detection type (hereinafter also denoted as an "FID type").

Solubility at 25° C. in the insulating liquid (L), of the shell resin (a) in the liquid developer (X-1) obtained as above was measured as follows.

Ten grams of the liquid developer (X-1) were centrifuged for 30 minutes at 10000 rpm at 25° C. and a whole amount of a supernatant was collected. Ten milliliters of the insulating liquid (L) were added to a solid content which remained, and the toner particles (C) were dispersed again. Thereafter, this solution was centrifuged for 30 minutes at 10000 rpm at 25° C. and a whole amount of a supernatant was collected. This operation was further repeated and the supernatant was collected three times in total. A reduced-pressure dryer was used to dry the supernatant for 1 hour at a reduced pressure of 20 mmHg at a temperature as high as a boiling point of the insulating liquid (L) and a mass of the residue was weighed. A mass Y [unit: g] of the residue at this time and a mass y [unit: g] of the shell resin (a) in 10 g of the liquid developer were substituted in Equation (6) below, so that solubility (25° C.) of the shell resin (a) in the insulating liquid (L) in the liquid developer (X-1) was found.

$$\text{Solubility(mass \%)}=(Y/y)\times 100 \quad (6)$$

As a result of measurement as above, solubility in (L) at 25° C., of the shell resin (a) in the liquid developer (X-1) was 3 mass %. Table 1 shows results.

Examples 2 to 5

Liquid developers (X-2) to (X-5) in the present embodiment were obtained as in Example 1 above, except that the solution for forming the core particles (B), a urethane prepolymer, a curing agent, a dispersion liquid of a coloring agent, liquid paraffin, and a dispersion liquid shown in Table 1 were used.

A field of the dispersion liquid (W) of the shell particles (A) in Table 1 shows a type of the dispersion liquid used. For example, "W1" shows that the dispersion liquid (W1) of the shell particles (A1) described in Manufacturing Example 1 above was used.

A field of a type of the solution for forming the core particles (B) shows a type of a solution for forming core particles used. For example, "B1" shows that the solution for forming the core particles (B1) described in Manufacturing Example 2 above was used.

A numeric value in a field of a urethane prepolymer, a curing agent, a dispersion liquid of a coloring agent, and liquid paraffin shows an amount of use (parts by mass).

Example 6

In a beaker, 8 parts by mass of a solution of a copolymer including the shell particles (A1) obtained in a process for manufacturing the dispersion liquid (W1) of the shell particles (A1) in Manufacturing Example 1-1, 45 parts by mass of the solution for forming the core particles (B1), and 15 parts by mass of the dispersion liquid of the coloring agent obtained in Manufacturing Example 4 were introduced and stirred at 8000 rpm with the use of T.K. Auto Homo Mixer (a trade name, manufactured by Tokushu Kika Kogyo Co., Ltd.) at 25° C. for uniform dispersion. Thus, a mixture solution of the solution of the copolymer including the shell particles (A1), the solution for forming the core particles (B1), and the dispersion liquid of the coloring agent was obtained.

In another beaker, 67 parts by mass of liquid paraffin were introduced, and then, 60 parts by mass of the mixture solution of the solution of the copolymer including the shell particles (A1), the solution for forming the core particles (B1), and the dispersion liquid of the coloring agent was introduced and stirred for 2 minutes while T.K. Auto Homo Mixer was used at 25° C. to perform stirring at 10000 rpm. Then, this liquid mixture was introduced in a reaction vessel provided with a stirrer, a heating and cooling apparatus, a thermometer, and a desolventizer, and a temperature was raised to 35° C. Thereafter, at a reduced pressure of 0.039 MPa at 35° C., acetone was distilled out until a concentration of acetone was not higher than 0.5 mass %. Thus, a liquid developer (X-6) was obtained.

Comparative Examples 1 to 4

Liquid developers (Z-1) to (Z-4) according to Comparative Examples were obtained as in Example 1 except that the solution for forming the core particles (B), a dispersion liquid of a coloring agent, liquid paraffin, and a dispersion liquid shown in Table 1 were used.

<Evaluation>

Each of the liquid developers (X-1) to (X-6) and (Z-1) to (Z-4) obtained in Examples 1 to 6 and Comparative Examples 1 to 4 was diluted with liquid paraffin and a volume average particle size and a coefficient of variation of volume distribution of the toner particles (C) were measured with "LA-920". A state of the shell particles (A) in the toner particles (C) was observed with a method below. Then, a ratio of surface coverage of the core particles (B) with the shell particles (A) in the toner particles (C) was measured with the method above. In addition, fixability and heat-resistant stability of the liquid developer were evaluated with a method below. Table 1 shows results.

<Evaluation of State of Shell Particles (A) in Toner Particles (C)>

Surfaces of 50 toner particles (C) were observed with a scanning electron microscope (SEM) and whether or not the shell particles (A) are attached to or form a film on surfaces of the core particles (B) was determined.

<Image Formation Apparatus>

FIG. 1 shows a schematic conceptual diagram of an image formation apparatus of an electrophotography type used for evaluation of fixability of the liquid developer in the present embodiment. In an image formation apparatus 1, a liquid developer 2 is taken by a supply roller 3 and leveled off by a restriction blade 4, so that a thin layer of liquid developer 2 having a prescribed thickness is formed on supply roller 3. In a case of an anilox roller, a groove in the roller is filled with the liquid developer and a defined amount is measured by the restriction roller. Then, the thin layer of liquid developer 2 moves from supply roller 3 to a development roller 5 and toner particles form a toner image on a photoconductor 6 as a result of nipping between development roller 5 and photoconductor 6. Thereafter, the toner image is transferred onto a recording material 11 as a result of nipping between photoconductor 6 and a back-up roller 10 and the image is fixed by heat rollers 12. Image formation apparatus 1 also includes a development roller cleaning blade 8 and a charging apparatus 9, in addition to the above.

<Evaluation of Fixation Strength>

The image formation apparatus shown in FIG. 1 was used to form a solid fill pattern (10 cm×10 cm, attached amount: 2 mg/m$^2$) of each liquid developer in Examples and Comparative Examples on coated paper of 128 g/cm$^2$ (a trade name: "OK top coat+" manufactured by Oji Paper Co., Ltd.) and to fix the pattern with a heat roller (180° C.×nipping time period of 30 msec.).

Thereafter, rubbing twice with an eraser (trade name: ink eraser "LION 26111" manufactured by Lion Office Products, Corp.) was carried out at pressing load of 1 kgf and a ratio of remaining image density was measured with a reflection density meter (trade name: "X-Rite model 404", manufactured by X-Rite, Incorporated.) and evaluated in three ranks below. Table 1 shows results in a field of fixation strength before storage.

Fixation strength A: Ratio of remaining image density being 90% or higher

Fixation strength B: Ratio of remaining image density being not lower than 80% and lower than 90%

Fixation strength C: Ratio of remaining image density being lower than 80%

In Table 1, fixation strength A represents highest in fixability, fixation strength B represents second highest, and fixation strength C represents lowest in fixability.

<Evaluation of High-Temperature Offset>

Contamination of a roller (high-temperature offset) was simultaneously determined. High-temperature offset was evaluated based on visual inspection of contamination of white paper by passing coated paper through the image formation apparatus and then passing white paper immediately after formation of an image on the coated paper. A case where contamination with toner was observed on white paper was denoted as "B" and a case where contamination was not observed was denoted as "A". Table 1 shows results in a field of offset before storage.

"A" in Table 1 indicates good high-temperature offset performance.

<Evaluation of Storage Characteristics>

Fixation strength and high-temperature offset were evaluated as above after each liquid developer in Examples and Comparative Examples was stored at rest for 7 days in an environment at a temperature of 50° C./humidity of 50%. Table 1 shows results in fields of fixation strength after storage and offset after storage.

TABLE 1

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| | | X-1 | X-2 | X-3 | X-4 | X-5 | X-6 | Z-1 | Z-2 | Z-3 | Z-4 |
| Solution for Forming Core Particles (B) | Type | B1 | B1 | B5 | B1 | B7 | B1 | B3 | B4 | B2 | B6 |
| | Amount of Use | 45 | 45 | 45 | 40 | 45 | 40 | 45 | 45 | 45 | 45 |
| Urethane Prepolymer | | — | — | — | 2.5 | — | — | — | — | — | — |
| Curing Agent | | — | — | — | 0.1 | — | — | — | — | — | — |
| Dispersion Liquid of Coloring Agent | | 15 | 15 | 15 | 15 | 15 | 15 | 15 | 15 | 15 | 15 |
| Liquid Paraffin | | 67 | 67 | 67 | 67 | 67 | 67 | 67 | 67 | 67 | 67 |
| Dispersion Liquid (W) of Shell Particles (A) | Type | W1 | W2 | W1 | W1 | W1 | — | W1 | W1 | W1 | W1 |
| | Amount of Use | 6 | 6 | 6 | 6 | 6 | — | 6 | 6 | 6 | 6 |
| Amount of Use of Solution of Copolymer Including Shell Particles (A1) | | — | — | — | — | — | 8 | | | | |
| pKa of Core Resin (b) | | 2.94 | 2.94 | 5.61 | 2.94 | 6.20 | 2.94 | 2.52 | 2.52 | — | 9.50 |
| Solubility (Mass %) of Shell Resin (a) in Insulating Liquid (L) | | 3 | 3 | 1 | 3 | 1 | 3 | 3 | 3 | 3 | 3 |
| Volume Average Particle Size (μm) of Toner Particles (C) | | 1.2 | 1.3 | 1.3 | 1.6 | 1.0 | 1.5 | 1.2 | 1.8 | 1.2 | 1.2 |
| Coefficient of Variation of Volume Distribution of Toner Particles (C) | | 50 | 40 | 40 | 35 | 40 | 40 | 50 | 30 | 50 | 50 |
| State of Shell Particles (A) in Toner Particles (C) | | Film Formed | Film Formed | Film Formed | Film Formed | Film Formed | Film Formed | Film Formed | Film Formed | Film Formed | Film Formed |

TABLE 1-continued

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Ratio (%) of Surface Coverage of Core Particles (B) with Shell Particles (A) | | 85 | 90 | 85 | 90 | 85 | 60 | 90 | 85 | 90 | 90 |
| Before Storage | Fixation Strength | A | A | B | B | A | A | A | B | C | C |
| | Offset | A | A | A | A | A | B | A | A | A | A |
| After Storage | Fixation Strength | A | A | B | B | A | A | A | B | C | C |
| | Offset | A | A | A | A | A | B | B | B | A | A |

As is clear from Table 1, it could be confirmed that the liquid developer in the present embodiment was the liquid developer (X) in which the toner particles (C) were dispersed in the insulating liquid (L), the toner particles (C) had the core-shell structure that the shell particles (A) containing the shell resin (a) were attached to or covered the surfaces of the core particles (B) containing the core resin (b), the core resin (b) had an acid group and an acid dissociation constant not smaller than 2.90 and not greater than 8.00, and hence it had excellent effects that it exhibited excellent fixability, it could be fixed in a wide temperature range, and deterioration during storage after fixation was extremely low.

Though the embodiments and the examples of the present invention have been described above, combination of features in each embodiment and example described above as appropriate is also originally intended.

It should be understood that the embodiments and the examples disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The liquid developer (X) according to the present invention is extremely useful in such an application as a paint, a liquid developer for electrophotography, a liquid developer for electrostatic recording, an oil-based ink for ink jet printer, or an ink for electronic paper. The liquid developer has high availability in other applications such as cosmetics, a spacer for manufacturing electronic components, and an electrorheological fluid.

REFERENCE SIGNS LIST

1 image formation apparatus; 2 liquid developer; 3 supply roller; 4 restriction blade; 5 development roller; 6 photoconductor; 7, 8 cleaning blade; 9 charging apparatus; 10 back-up roller; 11 recording material; and 12 heat roller.

The invention claimed is:

1. A liquid developer in which toner particles are dispersed in an insulating liquid, said toner particles having a core-shell structure that shell particles containing a shell resin are attached to or cover surfaces of core particles containing a core resin, said core resin having an acid group at a terminal of said core resin and an acid dissociation constant being 2.94 or 6.20, wherein said core resin is at least one selected from the group consisting of a polyester resin and a polyurethane resin, said polyester resin in formed from ethylene glycol, sebacic acid and phthalic anhydride, and said polyurethane resin is formed from a reaction of isophoron diisocyanate, trimellitic anhydride and polyester obtained from sebacic acid, adipic acid and ethylene glycol.

2. The liquid developer according to claim 1, wherein said toner particles have a volume average particle size not smaller than 0.01 μm and not greater than 100 μm, and said toner particles have a coefficient of variation of volume distribution not lower than 1% and not higher than 100%.

3. The liquid developer according to claim 1, wherein said toner particles have an average value of circularity not smaller than 0.92 and not greater than 1.0.

4. The liquid developer according to claim 1, wherein said shell resin is at least one selected from the group consisting of a vinyl resin, a polyester resin, a polyurethane resin, and an epoxy resin.

5. The liquid developer according to claim 1, wherein said shell resin includes a vinyl resin and is a homopolymer or a copolymer containing a constitutional unit derived from a monomer having polymerizable double bond.

6. The liquid developer according to claim 5, wherein said monomer having polymerizable double bond is a vinyl monomer having a molecular chain.

7. The liquid developer according to claim 6, wherein said vinyl monomer is at least one selected from the group consisting of a vinyl monomer having a straight-chain hydrocarbon chain having a carbon number from 12 to 27, a vinyl monomer having a branched hydrocarbon chain having a carbon number from 12 to 27, a vinyl monomer having a fluoro-alkyl chain having a carbon number from 4 to 20, and a vinyl monomer having a polydimethylsiloxane chain.

8. The liquid developer according to claim 1, wherein said core particles contain at least one of a wax and a modified wax obtained by graft polymerization of a vinyl polymer chain with the wax.

9. The liquid developer according to claim 1, wherein in said toner particles, a ratio of surface coverage of said core particles with said shell particles is not lower than 50%.

10. The liquid developer according to claim 1, being a paint, a liquid developer for electrophotography, a liquid developer for electrostatic recording, an oil-based ink for ink jet printer, or an ink for electronic paper.

11. The liquid developer according to claim 1, wherein said core particles contain said core resin and a coloring agent.

12. A method for manufacturing a liquid developer, comprising the steps of:

preparing a dispersion liquid of shell particles, in which the shell particles containing a shell resin are dispersed in an insulating liquid;

preparing a solution for forming core particles obtained by dissolving a core resin or a precursor of said core resin in an organic solvent;

forming core particles containing said core resin in said dispersion liquid by dispersing said solution for forming core particles in said dispersion liquid of said shell particles and obtaining toner particles having a core-shell structure that said shell particles are attached to or cover surfaces of said core particles; and obtaining a liquid developer by distilling out said organic solvent after said step of obtaining toner particles, said core resin having an acid group at a terminal of said core resin and an acid dissociation constant being 2.94 or 6.20, wherein said core resin is at least one selected from the group consisting of a polyester resin and a polyurethane resin, said polyester resin in formed from ethylene glycol, sebacic acid and phthalic anhydride, and said polyurethane resin is formed from a reaction of isophoron diisocyanate, trimellitic anhydride and polyester obtained from sebacic acid, adipic acid and ethylene glycol.

13. The method for manufacturing a liquid developer according to claim 12, wherein said organic solvent has a solubility parameter from 8.5 to 20 $(cal/cm^3)^{1/2}$.

14. The method for manufacturing a liquid developer according to claim 12, wherein said toner particles have a volume average particle size not smaller than 0.01 μm and not greater than 100 μm, and said toner particles have a coefficient of variation of volume distribution not lower than 1% and not higher than 100%.

15. The method for manufacturing a liquid developer according to claim 12, wherein said toner particles have an average value of circularity not smaller than 0.92 and not greater than 1.0.

16. The method for manufacturing a liquid developer according to claim 12 wherein said shell resin includes a vinyl resin and is a homopolymer or a copolymer containing a constitutional unit derived from a monomer having polymerizable double bond, said monomer having polymerizable double bond is a vinyl monomer having a molecular chain, and said vinyl monomer is at least one selected from the group consisting of a vinyl monomer having a straight-chain hydrocarbon chain having a carbon number from 12 to 27, a vinyl monomer having a branched hydrocarbon chain having a carbon number from 12 to 27, a vinyl monomer having a fluoro-alkyl chain having a carbon number from 4 to 20, and a vinyl monomer having a polydimethylsiloxane chain.

17. The method for manufacturing a liquid developer according to claim 12, wherein said core particles contain at least one of a wax and a modified wax obtained by graft polymerization of a vinyl polymer chain with the wax.

18. The method for manufacturing a liquid developer according to claim 12, wherein in said toner particles, a ratio of surface coverage of said core particles with said shell particles is not lower than 50%.

* * * * *